US006526376B1

(12) United States Patent
Villette et al.

(10) Patent No.: US 6,526,376 B1
(45) Date of Patent: Feb. 25, 2003

(54) SPLIT BAND LINEAR PREDICTION VOCODER WITH PITCH EXTRACTION

(75) Inventors: Stéphane Pierre Villette, Dissay sous Courcillon (FR); Ahmet Mehmet Kondoz, Guildford (GB)

(73) Assignee: University of Surrey, Guildford (GB)

( * ) Notice: Subject to any disclaimer, the term of this patent is extended or adjusted under 35 U.S.C. 154(b) by 0 days.

(21) Appl. No.: 09/446,646

(22) PCT Filed: May 18, 1999

(86) PCT No.: PCT/GB99/01581

§ 371 (c)(1),
(2), (4) Date: Feb. 22, 2000

(87) PCT Pub. No.: WO99/60561

PCT Pub. Date: Nov. 25, 1999

(30) Foreign Application Priority Data

May 21, 1998 (GB) ..... 981109

(51) Int. Cl.[7] ..... G10L 11/04
(52) U.S. Cl. ..... 704/207; 704/219
(58) Field of Search ..... 704/207, 200, 704/205, 206, 208–219

(56) References Cited

U.S. PATENT DOCUMENTS 4,731,846 A * 3/1988 Secrest et al. ..... 704/207
4,791,671 A 12/1988 Willems ..... 704/217
5,081,681 A 1/1992 Hardwick et al. ..... 704/268
5,195,166 A 3/1993 Hardwick et al. ..... 704/200
5,216,747 A 6/1993 Hardwick et al. ..... 704/208
5,930,747 A * 7/1999 Iijima et al. ..... 704/207

OTHER PUBLICATIONS

Gold and Rabiner, "Parallel Processing Techniques for Estimating Pitch Periods of Speech in the Time Domain", Journal of the Acoustical Society of America, vol. 46, No. 2, Part 2, 1969, pp 442–448.*

Atkinson et al., "High Quality Split Band LPC Vocoder Operating at Low Bit Rates," IEEE, 2, pp. 1559–1562 (Apr. 1997).

Boyanov et al., "Robust hybrid pitch detector," *Electronics Letters, 29*, pp. 1924–1926 (Oct. 1993).

Griffin and Lim, "A New Model–Based Speech Analysis/Synthesis System," *IEEE, 2*, pp. 513–516 (Mar. 1985).

McAulay and Quatieri, "Pitch Estimation and Voicing Detection Based on a Sinusoidal Speech Model," *IEEE, 1*, pp. 249–252 (Apr. 1990).

* cited by examiner

*Primary Examiner*—David D. Knepper
(74) *Attorney, Agent, or Firm*—Leydig, Voit & Mayer, Ltd.

(57) ABSTRACT

A speech coder includes an encoder using an analysis and synthesis approach. The encoder uses a pitch determination algorithm requiring analysis in both the frequency domain and the time domain, a voicing determination algorithm and an algorithm for determining spectral amplitudes and means for quantising the values determined. A decoder is also described.

51 Claims, 7 Drawing Sheets

SPLIT BAND LINEAR PREDICTION VOCODER WITH PITCH EXTRACTION

This invention relates to speech coders.

The invention finds particular, though not exclusive, application in telecommunications systems.

According to one aspect of the invention there is provided a speech coder including an encoder for encoding an input speech signal divided into frames each consisting of a predetermined number of digital samples, the encoder including: linear predictive coding (LPC) means for analysing samples and generating at least one set of linear prediction coefficients for each frame; pitch determination means for determining at least one value of pitch for each frame, the pitch determination means including first estimation means for analysing samples using a frequency domain technique (frequency domain analysis), second estimation means for analysing samples using a time domain technique (time domain analysis) and pitch evaluation means for using the results of said frequency domain and time domain analyses to derive a said value of pitch; voicing means for defining a measure of voiced and unvoiced signals in each frame; amplitude determination means for generating amplitude information for each frame, and quantisation means for quantising said set of linear prediction coefficients, said value of pitch, said measure of voiced and unvoiced signals and said amplitude information to generate a set of quantisation indices for each frame, wherein said first estimation means generates a first measure of pitch for each of a number of candidate pitch values, the second estimation means generates a respective second measure of pitch for each of said candidate pitch values and said evaluation means combines each of at least some of the first measures with the corresponding said second measure and selects one of the candidate pitch values by reference to the resultant combinations.

According to another aspect of the invention there is provided a speech coder including an encoder for encoding an input speech signal, the encoder comprising means for sampling the input speech signal to produce digital samples and for dividing the samples into frames each consisting of a predetermined number of samples, linear predictive coding (LPC) means for analysing samples and generating at least one set of linear prediction coefficients for each frame, pitch determination means for determining at least one value of pitch for each frame, voicing means for defining a measure of voiced and unvoiced signals in each frame, amplitude determnination means for generating amplitude information for each frame, and quantisation means for quantising said set of linear prediction coefficients, said value of pitch, said measure of voiced and unvoiced signals and said amplitude information to generate a set of quantisation indices for each frame, wherein said pitch determination means includes pitch estimation means for determining an estimate of the value of pitch and pitch refinement means for deriving the value of pitch from the estimate, the pitch refinement means defining a set of candidate pitch values including fractional values distributed about said estimate of the value of pitch determined by the pitch estimation means, identifying peaks in a frequency spectrum of the frame, for each said candidate pitch value correlating said peaks with amplitudes at different harmonic frequencies ($k\omega_o$) of a frequency spectrum of the frame, where $$\omega_o = \frac{2\pi}{P},$$

P is a said candidate pitch value and k is an integer, and selecting as a said value of pitch the candidate pitch value giving the maximum correlation.

According to a further aspect of the invention there is provided a speech coder including an encoder for encoding an input speech signal, the encoder comprising means for sampling the input speech signal to produce digital samples and for dividing the samples into frames, each consisting of a predetermined number of samples, linear predictive coding (LPC) means for analysing samples and generating at least one set of linear prediction coefficients for each frame, pitch determination means for determining at least one value of pitch for each frame, voicing means for determining for each frame a voicing cut-off frequency for separating a frequency spectrum from the frame into a voiced part and an unvoiced part without evaluating the voiced/unvoiced status of individual harmonic frequency bands, amplitude determination means for generating amplitude information for each frame, and quantisation means for quantising said set of coefficients, said value of pitch, said voicing cut-off frequency and said amplitude information to generate a set of quantisation indices for each frame.

According to a yet further aspect of the invention there is provided a speech coder including an encoder for encoding an input speech signal, the encoder comprising, means for sampling the input speech signal to produce digital samples and for dividing the samples into frames each consisting of a predetermined number of samples, linear predictive coding (LPC) means for analysing samples and generating at least one set of linear prediction coefficients for each frame, pitch determination means for determining at least one value of pitch for each frame, voicing means for defining a measure of voiced and unvoiced signals in each frame, amplitude determination means for generating amplitude information for each frame, and quantisation means for quantising said set of prediction coefficients, said value of pitch, said measure of voiced and unvoiced signals and said amplitude information to generate a set of quantisation indices for each frame, wherein the amplitude determination means generates, for each frame, a set of spectral amplitudes for frequency bands centred on frequencies harmonically related to the value of pitch determined by the pitch determination means, and the quantisation means quantises the normalised spectral amplitudes to generate a first part of an amplitude quantisation index.

According to a yet further aspect of the invention there is provided a speech coder including an encoder for encoding an input speech signal, the encoder comprising means for sampling the input speech signal to produce digital samples and for dividing the samples into frames each consisting of a predetermined number of samples, linear predictive coding means for analysing samples to generate a respective set of Line Spectral Frequency (LSF) coefficients for a leading part and for a trailing part of each frame, pitch determination means for determining at least one value of pitch for each frame, voicing means for defining a measure of voiced and unvoiced signals in each frame, amplitude determination means for generating amplitude information for each frame, and quantisation means for quantising said sets of LSF coefficients, said value of pitch, said measure of voiced and unvoiced signals and said amplitude information to generate a set of quantisation indices, wherein said quantisation means defines a set of quantised LSF coefficients (LSF'2) for the leading part of the current frame by the expression $$LSF'2 = \alpha LSF'1 + (1-\alpha)\, LSF'3,$$

where LSF'3 and LSF'1 are respectively sets of quantised LSF coefficients for the trailing parts of the current frame and the frame immediately preceding the current frame, and $\alpha$ is a vector in a first vector quantisation codebook, defines each said set of quantised LSF coefficients LSF'2,LSF'3 for the leading and trailing parts respectively of the current frame as a combination of respective LSF quantisation vectors Q2,Q3 of a second vector quantisation codebook and respective prediction values P2,P3, where P2=$\lambda$Q1 and P3=$\lambda$Q2, $\lambda$ is a constant and Q1 is a said LSF quantisation vector for the trailing part of said immediately preceding frame, and selects said vector Q3 and said vector a from the first and second vector quantisation codebooks respectively to minimise a measure of distortion between the LSF coefficients generated by the linear predictive coding means (LSF2, LSF3) for the current frame and the corresponding quantised LSF coefficients (LSF'2, LSF'3).

According to yet a further aspect of the invention there is provided a speech coder for decoding a set of quantisation indices representing LSF coefficients, pitch value, a measure of voiced and unvoiced signals and amplitude information, including processor means for deriving an excitation signal from said indices representing pitch value, measure of voiced and unvoiced signals and amplitude information, a LPC synthesis filter for filtering the excitation signal in response to said LSF coefficients, means for comparing pitch cycle energy at, the LPC synthesis filter output with corresponding pitch cycle energy in the excitation signal, means for modifying the excitation signal to reduce a difference between the compared pitch cycle energies and a further LPC synthesis filter for filtering the modified excitation signal.

Embodiments according to the invention are now described, by way of example only, with reference to the accompany drawings in which:

FIG. 6(*b*) shows spectral amplitudes derived from the LPC spectrum of FIG. 6(*a*);

FIG. 6(*c*) shows a quantisation vector derived from the spectral amplitudes of FIG. 6(*b*);

Figure 1:
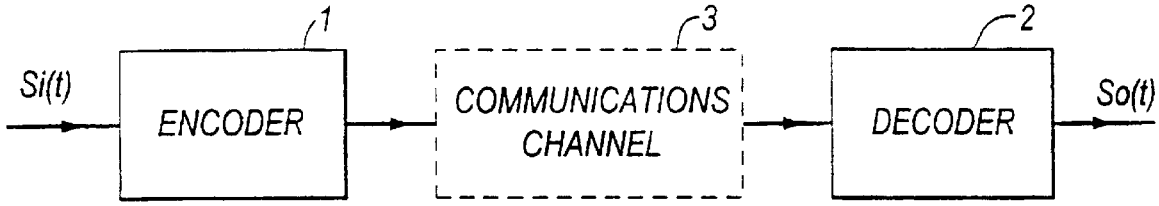
FIG. 1 is a generalised representation of a speech coder.

It will be appreciated that the encoders and decoders described hereinafter with reference to the drawings are implemented algorithmically, as software instructions carried out in a suitable designated signal processor. The blocks shown in the drawings are intended to facilitate explanation of the function of each processing step carried out by the processor, rather than to represent discrete hardware components in the speech coder. Alternatively, of course, the encoders and decoders could be implemented using hardware components.

FIG. 1 is a generalised representation of a speech coder, comprising an encoder 1 and a decoder 2. In use, an analogue input speech signal $S_i(t)$ is received at the encoder 1 where it is sampled, typically at a sampling frequency of 8 kHz. The sampled speech signal is then divided into frames and each frame is encoded to produce a set of quantisation indices which represent the waveform of the input speech signal, but contain relatively few bits. The quantisation indices for successive frames are transmitted to the decoder 2 over a communications channel 3, and the decoder 2 processes the received quantisation indices to synthesize an analogue output speech signal $S_O(t)$ corresponding to the original input speech signal. In the case of a telecommunications link using a speech coder, the speech channel requires an encoder at the speech signal input end and a decoder at the reception end. Therefore, the speech coder associated with one end of the telecommunications link requires both an encoder and a decoder which may be connected to separate channels in the case of a duplex link or the same channel in the case of a simplex link.

Figure 2:
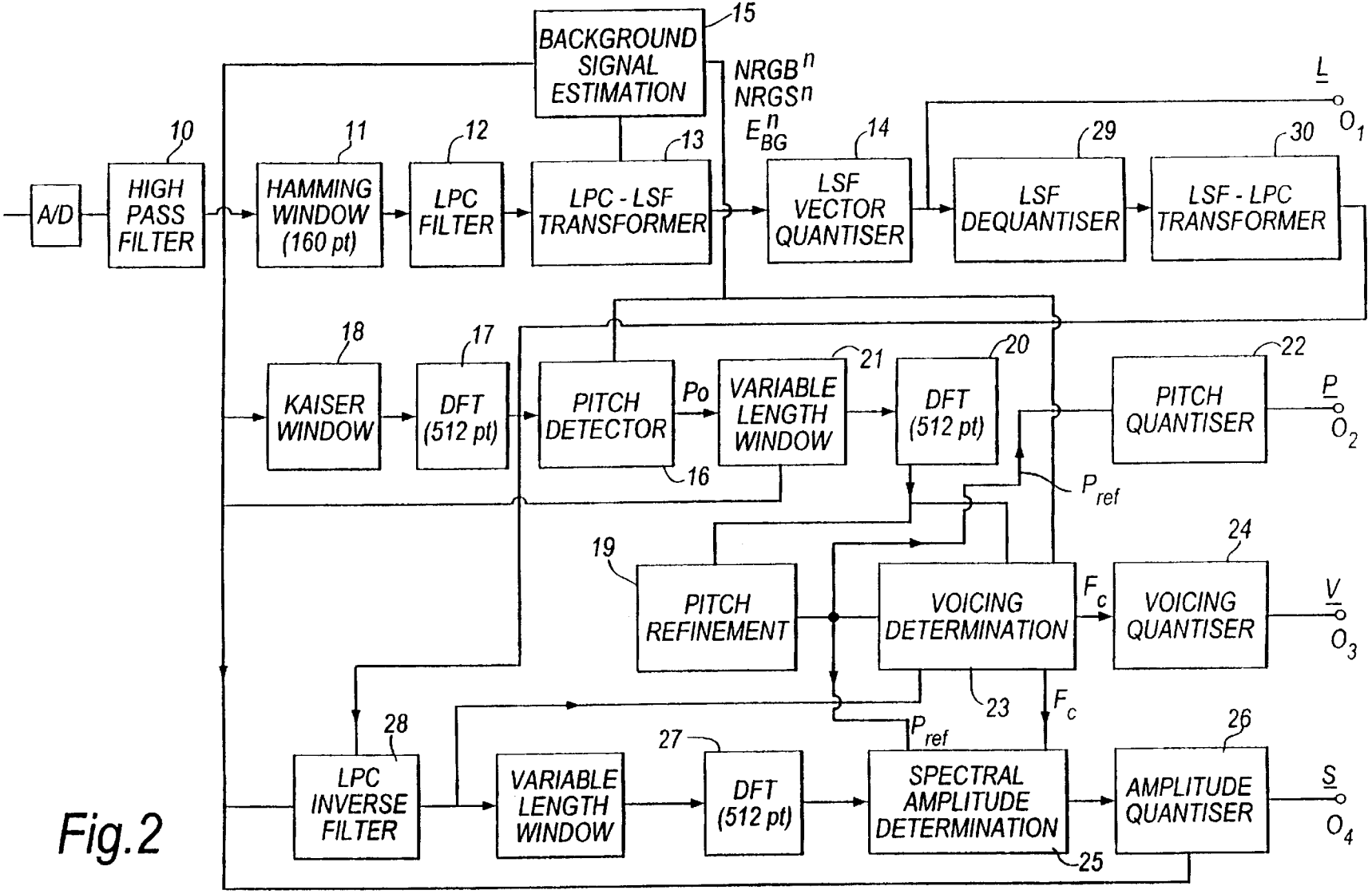
FIG. 2 is a block diagram showing the encoder of a speech coder according to the invention.

FIG. 2 shows the encoder of one embodiment of a speech coder according to the invention referred to hereinafter as a Split-Band LPC (SB-LPC) speech coder. The speech coder uses an Analysis and Synthesis scheme.

The described speech coder is designed to operate at a bit rate of 2.4 kb/s; however, lower and higher bit rates are possible (for example, bit rates in the range from 1.2 kb/s to 6.8 kb/s) depending on the level of quantisation used and the rate at which the quantisation indices are updated.

Initially, the analogue input speech signal is low pass filtered to remove frequencies outside the human voice range. The low pass filtered signal is then sampled at a sampling frequency of 8 kHz. The resultant digital signal $d_i(t)$ is then preconditioned by passing the signal through a high-pass filter 10 which, in this particular implementation has a transfer function H(z) of the form $$H_1(z) = \frac{1 - z^{-1}}{1 - 0.9183z^{-1}}.$$

The effect of the high-pass filter 10 is to remove any DC level that might be present.

The preconditioned digital signal is then passed through a Hamming window 11 which is effective to divide the signal into frames. In this example, each frame is 160 samples long, corresponding to a frame up-date time interval of 20 ms. The coefficients $W_{Hamm}(i)$ of the Hamming window 11 are defined as $$W_{Hamm}(i) = 0.54 - 0.46\cos\left(\frac{2\pi i}{159}\right) \text{ for } 0 \le i \le 159.$$

The frequency spectrum of each frame is then modelled on the output of a linear time-varying filter, more specifically an all-pole linear predictive LPC filter 12 having a preset number L of LPC coefficients which are obtained using the known Levinson-Durbin algorithm. The LPC filter 12 attempts to establish a linear relationship between each input sample in the current frame and the L preceding samples. Therefore, if the $i^{th}$ input sample is represented as $a_i$ and the LPC coefficients are represented as LPC(j), then the values of LPC(j) are chosen to minimise the expression:

$$\epsilon = \sum_{i=0}^{N}\left[a_i - \sum_{j=1}^{L} LPC(j-1)a_{i-j}\right]^2$$

where, in this example, N=160 and L=10.

The LPC coefficients LPC(0),LPC(1) . . . LPC(9) are then transformed to generate corresponding Line Spectral Frequency (LSF) coefficients LSF(0), LSF(1) . . . LSF(9) for the frame. This is carried out in LPC-LSF transformer 13 using a known root search method.

The LSF coefficients are then passed to a vector quantiser 14 where they undergo a vector quantisation process to generate an LSF quantisation index L for the frame which is routed to a first output $O_1$ of the encoder. Alternatively, the LSF coefficients could be quantised using scalar quantisers.

As is known, LSF coefficients are always monotonic and this makes the quantisation process easier than would be the case using LPC coefficients. Furthermore, the LSF coefficients facilitate frame-to-frame interpolation, a process needed in the decoder.

The vector quantisation process takes account of the relative frequencies of the LSF coefficients in such a way as to give greater weight to coefficients which are relatively close in frequency and therefore representative of a significant peak in the frequency spectrum of the input speech signal.

In this particular implementation of the invention, the LSF coefficients are quantised using a total of 24 bits. The coefficients LSF(0), LSF(1),LSF(2) form a first group $G_1$ which is quantised using 8 bits, coefficients LSF(3),LSF(4), LSF(5) form a second group $G_2$ which is quantised using 8 bits and coefficients LSF(6),LSF(7),LSF(8),LSF(9) form a third group $G_3$ which is also quantised using 8 bits.

Each group of LSF coefficients is quantised separately. By way of illustration, the quantisation process will be described in detail with reference to group $G_1$; however, substantially the same process is also used for groups $G_2$ and $C_3$.

The vector quantisation process is carried out using a codebook containing $2^8$ entries, numbered 1 to 256, the $r^{th}$ entry in the codebook consisting of a vector $V_r$ of three elements $V_r(0)$, $V_r(1)$, $V_r(2)$ corresponding to the coefficients LSF(0),LSF(1),LSF(2) respectively. The aim of the quantisation process is to select a vector $V_r$ which best matches the actual LSF coefficients.

For each entry in the codebook, the vector quantiser 14 forms the summation $$\sum_{i=o}^{i=2}[(V_r(i)-LSF(i))W(i)]^2,$$

where W(i) is a weighting factor, and the entry giving the minimum summation defines the 8 bit quantisation index for the LSF coefficients in group $G_1$.

The effect of the weighting factor is to emphasise the importance in the above summations of the more significant peaks for which the LSF coefficients are relatively close.

The RMS energy $E_o$ of the 160 samples in the current frame n is calculated in background signal estimation block 15 and this value is used to update the value of a background energy estimate $E_{BG}{}^n$ according to the following criteria:

$$E_{BG}^n=\begin{cases}\dfrac{E_{BG}^{n-1}}{1.03} \text{ if } E_0<\dfrac{E_{BG}^{n-1}}{1.03}\\ E_{BG}^{n-1}\times 1.01 \text{ if } E_0>E_{BG}^{n-1}\times 1.01\\ E_0 \text{ if } \dfrac{E_{BG}^{n-1}}{1.03}\le E_0\le E_{BG}^{n-1}\times 1.01\end{cases}$$

where $E_{BG}{}^{n-1}$ is the background energy estimate for the immediately preceding frame, n−1.

If $E_{BG}{}^n$ is less than 1, then $E_{BG}{}^n$ is set at 1.

The values of $E_{BG}{}^n$ and $E_o$ are then used to update the values of NRGS and NRGB which represent the expected values of the RMS energy of the speech and background components respectively of the input signal according to the following criteria:

$$NRGB^n=\begin{cases}NRGB^{n-1} \text{ if } E_o>1.5E_{BG}^n\\ \left\{\begin{array}{l}0.5(NRGB^{n-1}+E_o) \text{ if } E_o\le NRGB^{n-1}\\ 0.97NRGB^{n-1}+0.03E_o \text{ if } E_o>NRGB^{n-1}\end{array}\right\} \text{ if } E_o\le 1.5E_{BG}^n\end{cases}$$

and if $NRGB^n<0.05$ then $NRGB^n$ is set at 0.05, and $$NRGS^n=\begin{cases}NRGS^{n-1} \text{ if } E_o\le 2.0E_{BG}^n\\ \left\{\begin{array}{l}0.5(NRGS^{n-1}+E_o) \text{ if } E_o>NRGS^{n-1}\\ 0.99NRGS^{n-1}+0.01\ E_o \text{ if } E_o\le NRGS^{n-1}\end{array}\right\} \text{ if } E_o>2E_{BG}^n\end{cases}$$

and if $NRGS^n<2.0$, then $NRGS^n$ is set at 2.0 and if $NRGB^n>NRGS^n$ then $NRGS^n$ is set to $NRGB^n$.

Figure 3:
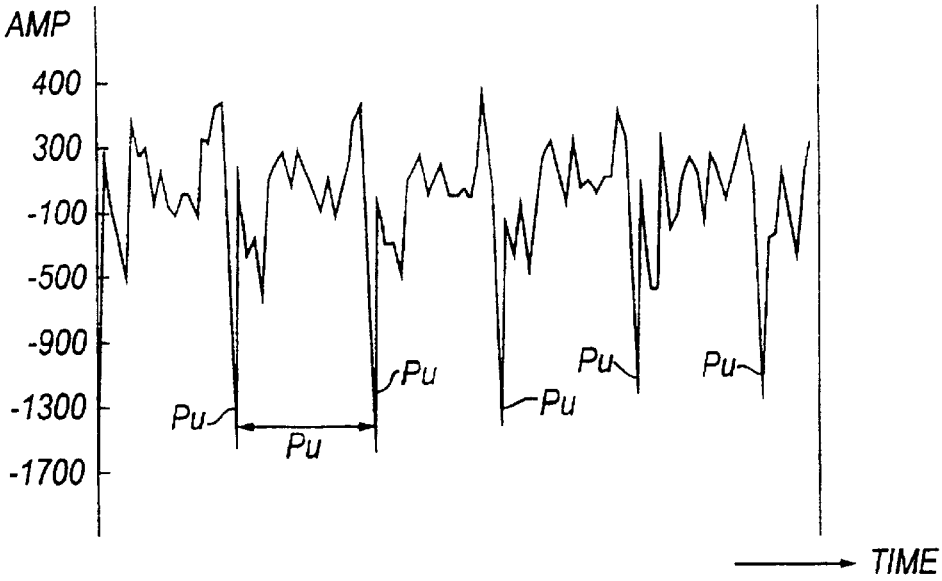
FIG. 3 shows a waveform of an analogue input speech signal.

By way of illustration, FIG. 3 depicts the waveform of an analogue input speech signal $S_i(t)$ contained within the interval (20 ms long) of the current frame $F_0$. The waveform exhibits relatively large amplitude pitch pulses $P_u$ which are an important characteristic of human speech. The pitch or pitch period P for the frame is defined as the time interval between consecutive pitch pulses in the frame and this can be expressed in terms of the number of samples contained within that time interval. The pitch period P is inversely related to the fundamental pitch frequency $\omega_o$, where $$\omega_o=\frac{2\pi}{P}.$$

For speech sampled at 8 kHz it is reasonable to consider a pitch period of from 15 to 150 samples, corresponding to a fundamental pitch frequency in the range from about 50 Hz to 535 Hz. The fundamental pitch frequency $\omega_o$ will, of course, be accompanied by a number of harmonic frequencies.

As already explained, pitch period P is an important characteristic of the speech signal and therefore forms the basis of another quantisation index P which is routed to a second output $O_2$ of the encoder. Furthermore, as will become clear, the pitch period P is central to the determination of other quantisation indices produced by the encoder. Therefore, considerable care is taken to evaluate the pitch period P with the required precision and in as reliable a manner as possible. To this end, a pitch detector 16 subjects each frame to analysis both in the frequency domain and in the time domain using a pitch detection algorithm which is now described in detail with reference to FIG. 4.

To facilitate analysis in the frequency domain, a discrete Fourier transform is performed in DFT block 17 using a 512 point fast Fourier transform (FFT) algorithm. Samples are supplied to the DFT block 17 via a 221 point Kaiser window 18 centred on the current frame and the samples are padded with zeros to bring their number to 512.

Figure 4:
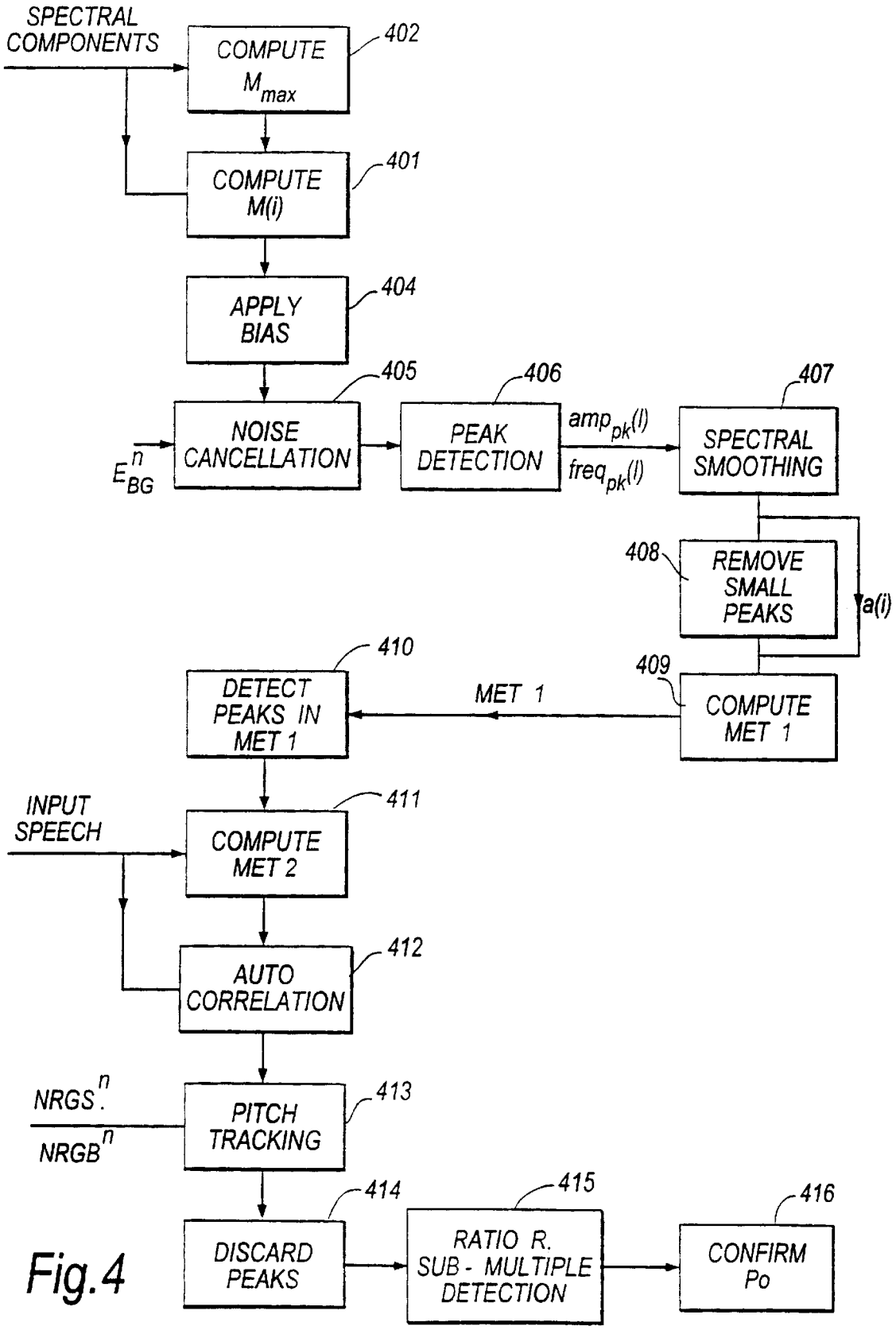
FIG. 4 is a block diagram showing a pitch detection algorithm used in the encoder of FIG. 2.

Referring to FIG. 4, the magnitudes M(i) of the resultant frequency spectrum are calculated in block 401 using the real and imaginary components SWR(i) and SWI(i) of the transform, and in order to reduce complexity this is done at each frequency i up to a predetermined cut-off frequency (Cut), where i is expressed in terms of the output samples of the FFT running from 0 to 255. In this embodiment, the cut-off frequency is at i=90, corresponding to 1.5 kHz which far exceeds the maximum expected fundamental pitch frequency.

The magnitudes M(i) are calculated as $$M(i)=(SWR(i)^2+SWI(i)^2)^{1/2} \text{ for } O \leqq i \leqq \text{Cut}-1$$

and the RMS value of M(i), $M_{max}$ is calculated in block 402, as $$M_{\max} = \left[\frac{1}{Cut}\sum_{i=0}^{i-Cut-1}(M(i))^2\right]^{\frac{1}{2}}$$

In order to improve the performance of the pitch estimation algorithm, the magnitudes M(i) are preprocessed in blocks 404 to 407.

Initially, in block 404, a bias is applied in order to de-emphasise the main peaks in the frequency spectrum. If any magnitude M(i) exceeds $M_{max}$ it is replaced by a new magnitude given by $(M(i)M_{max})^{1/2}$. A further bias is then applied to emphasise the lower frequencies which are more important in terms of their speech content, and, to this end, each magnitude is weighted by the factor $$\left(1-\frac{i}{Cut+5}\right).$$

To improve performance against background noise, a noise cancellation algorithm is applied to the weighted magnitudes in block 405. To this end, each magnitude M(i) is tracked during non-speech frames to obtain an estimate $M_{mem}(i)$ of background noise. If $E_O<1.5\ E_{BG}{}^n$ the value of $M_{mem}(i)$ is up-dated to produce a new value $M'_{mem}(i)$ given by:

$$M'_{mem}(i)=0.9\ M_{mem}(i)+0.1\ M(i)$$

If the ratio $$\frac{NRGS^n}{NRGB^n}$$

is less than a threshold value (typically in the range from 5 to 20) and no update of $M_{mem}$ has taken place for the current frame indicating that the frame contains significant background noise in addition to speech then the value $kM'_{mem}(i)$ (where k is a constant, typically 0.9) is subtracted from M(i) for each frequency i in the frequency spectrum in order to reduce the effect of the background noise. If the difference is negative or close to zero, less than a threshold value, 0.0001 say, then M(i) is set at the threshold value.

The resultant magnitudes M'(i) are then analysed in block 406 to detect for peaks. This is done by comparing each magnitude M'(i) (apart from those at the extremes of the frequency range) with its immediate neighbours M'(i−1) and M'(i+1), and if it is higher than both it is declared a peak. For each peak so detected its magnitude is stored as $amp_{pk}(l)$ and its frequency is stored as $freq_{pk}(l)$, where 1 is the number of the peak.

A smoothing algorithm is then applied to the magnitudes M'(i) in block 407 to generate a relatively smooth envelope for the frequency spectrum. The smoothing algorithm is carried out in two stages. In the first stage, a variable x is initialised at zero and is compared with the magnitude M'(i) at each value of i starting at zero and finishing at Cut−1. If x is less than M'(i), x is set to that value; otherwise, the value of M'(i) is set to x, and x is multiplied by an envelope decay factor, 0.85 in this example. The same procedure is then carried out again, but in the opposite direction, i.e. for values of i starting at Cut−1 and finishing at zero.

The effect of this process is to generate a set of magnitudes a(i) for $0 \leqq i \leqq \text{Cut}-1$ representing a smoothed, exponentially decaying envelope of the frequency spectrum; in particular, the process is effective to eliminate relatively small peaks residing next to larger peaks.

It will be apparent that the peak-detection process carried out in block 406 will identify any peak, even small ones. In order to reduce the amount of processing in subsequent stages of the algorithm a peak is discarded by block 408 if its magnitude $amp_{pk}$ is less than a factor c times the magnitude a(i) at the same frequency. In this example, c is set at 0.5.

The magnitude values a(i) generated in block 407, and the remaining amplitude and frequency values, $amp_{pk}$ and $freq_{pk}$ generated in blocks 406 and 408 are used in block 409 to evaluate a first estimate of the pitch period.

To this end, a function Met1 is evaluated for each candidate pitch period P in the range from 15 to 150. To reduce complexity this may be done using steps of 0.5 up to the value 75, and steps of unity thereafter. Met1 is evaluated using the expression:

$$Met1(\omega_o) = \sum_{k=1}^{k=K(\omega_o)} a(k\omega_o)e(k\omega_o) - \frac{1}{2}\sum_{k=1}^{k=K(\omega_o)}(a(k\omega_o))^2 \rightarrow \text{EQ 1},$$

where $e(k, \omega_o)=\text{Max}_1(amp_{pk}\ (1)D(freq_{pk}(1)-k\omega_o))$, $$\omega_o = \frac{2\pi}{P},$$

$K(\omega_o)$ is the number of harmonics below the cut-off frequency, and $D(freq_{pk}(1)-k\omega_o)=\text{sinc}\ (freq_{pk}(1)-k\omega_o)$.

In effect, this expression can be thought of as the cross-correlation function between the frequency response of a comb filter defined by the harmonic amplitudes $a(k\omega_o)$ of the pitch candidate P and the optimum peak amplitudes $e(k\omega_o)$. The function $D(freq_{pk}(1)-k\omega_o)$ is a distance measure related to the frequency separation between the $l^{th}$ peak in the frequency spectrum and the $k^{th}$ harmonic frequency of the pitch candidate P within a specified search distance. As $e(k\omega_o)$ depends on both the distance measure and on peak amplitude it is possible that the optimum value $e(k\omega_o)$ might not correspond to the minimum separation between the harmonic frequency $k\omega_o$ and the frequencies of the peaks.

Having evaluated Met1$(\omega_o)$ for each pitch candidate P the values obtained are multiplied by a weighting factor $$b1 = \left(1-0.1\frac{P}{150}\right)$$

so as to bias the values slightly in favour of the smaller pitch candidates.

The higher the value of Met1$(\omega_o)$, the greater the likelihood that the corresponding pitch candidate is the actual pitch value. Moreover, if the pitch candidate is twice the actual pitch value (i.e. pitch doubling) the value of Met1$(\omega_o)$ will be small; as will be described, this leads to the elimination of these unwanted pitch candidates at a later stage in the processing.

In order to identifly the most promising pitch candidates, peak values of Met1$(\omega_o)$ are detected in block 410. This is done by processing the values of Met1$(\omega_o)$ generated in block 409 to detect for a maximum in each of five contiguous ranges of pitch, i.e. in pitch ranges 15 to 27.5, 28 to 49.5, 50 to 94.5, 95 to 124.5, 125 to 150 and a maximum value within the range ±5 of a tracked pitch trP (to be described later). The five contiguous pitch ranges are so selected as to eliminate the possibility of pitch doubling or pitch halving within each range; that is, a peak detected in a range cannot have twice or half of the pitch of any other peak in the same range. By this means, six peak values Met1(1),Met1(2), Met1(3),Met1(4),Met1(5),Met1(6) are retained for further processing along with their respective pitch values $P_1,P_2,P_3,P_4,P_5,P_6$. Although the value of $\omega_o$ which maximises Met1($\omega_o$) provides a reasonable estimation of pitch value, it is sometimes susceptible to error; in particular, it might sometimes identify a pitch value which is half the actual pitch value (i.e. a pitch halving).

To alleviate this problem, a second estimate of pitch is evaluated in block 411 for each of the six candidate pitch values $P_1,P_2,P_3,P_4,P_5,P_6$ derived from the first estimate.

The second estimate is evaluated using a time-domain analysis technique by forming different summations of the absolute values |d(i)| of the input samples over a single pitch period P. To that end, the summation $$f(k, P) = \sum_{i=k}^{i=k+P} |d(i)|$$

is formed for each value of k between N−80 and N+79, where N is the sample number at the centre of the current frame. Thus, for each candidate pitch value $P_1,P_2,P_3,P_4,P_5,P_6$ a respective set of 160 summations is generated, each summation in the set starting at a different position in the frame.

If a pitch candidate is close to the actual pitch value, there should be little or no variation between the summations of the corresponding set. However, if the candidate and actual pitch values are very different (e.g. if the candidate pitch value is half the actual pitch value) there will be significant variation between the summations of the set. In order to detect for any such variation, the summations of each set are high-pass filtered and the sum of the squares of the resultant high-pass filtered values is used to evaluate a second estimate Met2. A small offset value is added to reduce pitch multiple errors when the speech is extremely periodic. A respective second estimate Met2(1),Met2(2)Met2(3),Met2(4),Met2(5),Met2(6) is evaluated for each of the candidate pitch values $P_1,P_2,P_3,P_4,P_5,P_6$ selected using the first estimate. Clearly, the smaller the value of Met2 the more likely that the corresponding pitch candidate is the actual pitch value. In the case of pitch halving, the value of Met2 will be large and this facilitates the elimination of this unwanted pitch candidate.

Optionally, the input samples for the current frame may be autocorrelated in block 412 with a view to further improving the reliability of the first and second estimates Met1 and Met2. The normalised autocorrelations are examined to find the two highest values ($V_1,V_2$), and the corresponding lags $L_1,L_2$ (expressed as a number of samples) between consecutive occurrences of those values are also determined. If the ratio between $V_1$ and $V_2$ exceeds a preset threshold value (typically about 1.1), then the confidence is high that the values $L_1L_2$ are close to the correct pitch value. If so, the values of Met1 and Met2 for candidate pitch values which come close to $L_1$ or $L_2$ are multiplied by respective weighting factors $b_2$ and $b_3$ to improve their chances of selection in the final estimation of pitch value.

The values of Met1 and Met2 are further weighted in block 413 according to a tracked pitch value, trP. Provided the current frame contains speech i.e. if $E_O>1.5\ E_{BG}{}^n$, the value of trP is updated using the pitch value estimated for the immediately preceding frame, the extent of the up-date being greater for higher values of speech energy. The ratio, $$\gamma = \frac{P - trP}{trP},$$

is then evaluated for each candidate pitch value $P_1,P_2,P_3,P_4,P_5,P_6$.

In this example, if γ is less than 0.5, i.e. the candidate pitch value is close to the tracked pitch value estimated from the pitch values of earlier frames, the respective values of Met1 and Met2 are multiplied by further weighting factors $b_4$ and $b_5$ respectively. The values of $b_4$ and $b_5$ depend upon the level of background noise in the frame. If this is determined to be relatively high, e.g.

$$\frac{NRGS}{NRGB} < 10,$$

$b_4$ is set at 1.25 and $b_5$ is set at 0.85. However, if γ<0.3 (i.e. the candidate pitch value is even closer to the tracked value) $b_4$ is set at 1.56 and $b_5$ is set at 0.72. If it is determined that there is no significant background noise, e.g.

$$\frac{NRGS}{NRGB} > 10,$$

the extent of the bias is reduced—if γ<0.5, $b_4$ is set at 1.1 and $b_5$ is set at 0.9 and for γ<0.3, $b_4$ is set at 1.21 and $b_5$ is set at 0.8.

The weighted values of Met2 are then used to discard any candidate pitch value which is clearly unpromising. To this end, the weighted values of Met2 are analysed in block 414 to detect for the minimum value and if any other value exceeds this minimum by more than a preset factor (e.g. 2.0) plus a constant (e.g. 0.1) it is discarded along with the corresponding values of Met1($\omega_o$) and P.

As already described, if the pitch candidate is close to the correct value, Met1 will be very large and Met2 will be very small; therefore, a ratio derived from Met1 and Met2 provides a very sensitive measure of the correctness or otherwise of the pitch candidates.

Accordingly, in block 415, the ratio $$R = \frac{Met'1}{Met'2^{0.25}},$$

where Met'1 and Met'2 are the weighted values of Met1 and Met2, is evaluated for each of the remaining pitch candidates, and the candidate pitch value corresponding to the maximum ratio R is selected as the estimated pitch value $P_o$ for the current frame. A check is then made to confirm that the estimated pitch value $P_o$ is not a submultiple of the actual pitch value. To this end, the ratio $$S_m = \frac{P_o}{P_n}$$

is calculated for each remaining candidate pitch value $P_n$ and provided this ratio is close to an integer greater than 1 (e.g. within 0.3 of that integer), $P_o$ is confirmed in block 416 as the estimated pitch value for the frame.

The pitch algorithm described in detail with reference to FIG. 4 is extremely robust and involves the combination of both frequency and time domain techniques to eliminate pitch doubling and pitch halving.

Although the pitch value $P_o$ is estimated to an accuracy within 0.5 samples or 1 sample depending on the range within which the candiate value falls, this accuracy may not be sufficient for the processing which needs to be carried out in subsequent stages of the encoder, and so better accuracy is needed. Therefore, a refined pitch value is estimated in pitch refinement block 19.

To facilitate this, a second discrete Fourier transform is performed in DFT block 20, again using a 512 point fast Fourier transformation algorithm. As described earlier, samples were supplied to DFT block 17 via a 221 point Kaiser window 18. This window is too wide for the processing techniques that are now required, and so a narrower window is needed. Nevertheless, the window should still be at least three pitch periods wide. Therefore, the input samples are supplied to DFT block 20 via a variable length window 21 which is sensitive to the pitch value $P_o$ detected in pitch detector 16. In this example, three different window sizes are used 221,181 and 161 respectively corresponding to the ranges $P_o>70$, $70>P_o\geqq 55$ and $55>P_o$. Again, these are Kaiser windows centred on the current frame.

The pitch refinement block 19 generates a new set of candidate pitch values containing fractional values distributed to either side of the estimated pitch value $P_o$. In this embodiment, a total of 50 such pitch candidate pitch values (including $P_o$) is used. A new value of Met1 is then computed for each of these candidate pitch values, and the candidate pitch value giving the maximum value of Met1 is selected as the refined pitch value $P_{ref}$ upon which all subsequent processing will be based.

The new values of Met1 are computed in pitch refinement block 19 using substantially the same process as that described earlier with reference to FIG. 4, but with certain important modifications. Firstly, the magnitudes M(i) are calculated for the entire frequency spectrum generated by DFT block 20, instead of only for the low frequency range of the spectrum (i.e. values of i up to Cut−1). Secondly, the summation expressed in Equation 1 above is performed in two parts; a first (low frequency) part for values of $k\omega_o$ up to 1.5 kHz (corresponding to i=90), and a second (high frequency) part for the remaining values of $k\omega_o$, and these two parts of the summation are weighted by different factors, 0.25 and 1.0 respectively.

As already described, the estimated pitch value $P_o$ was based on an analysis of the low frequency range only and so any inaccuracy in this estimate is largely attributable to the effect of the higher frequencies which were excluded from the analysis. In order to rectify this omission, the higher frequencies are included in the analysis carried out in block 19, and their effect is emphasised by the relative magnitudes of the weighting factors applied to the respective parts of the summation. Furthermore, the bias originally applied to the magnitude values M(i) in block 404, and which had the (now unwanted) effect of emphasising the lower frequencies is omitted from the analysis, and consequently the value $M_{max}$ (originally evaluated in block 402) is not required either.

The refined pitch value $P_{ref}$ generated in block 19 is passed to vector quantiser 22 where it is quantised to generate the pitch quantisation index P.

In this embodiment, the pitch quantisation index P is defined by seven bits (corresponding to 128 levels), and the vector quantiser 22 is an exponential quantiser to take account of the fact that the human ear is less sensitive to pitch inaccuracies at larger pitch values. The quantised pitch levels $L_p(i)$ are defined as $$L_p(i) = 15\left(\frac{150}{15}\right)^{\frac{i}{127}}, \text{ for } 0 \le i \le 127.$$

It will be appreciated that at a sampling rate of 8 kHz as many as up to 80 harmnonic frequencies may be contained within the 4 kHz bandwidth of the DFT block 20. Clearly, a very large number of bits would be needed to encode all these harmnonics individually, and this is not practicable in a speech encoder for which a relatively low bit rate is required, A more economical encoding model is needed.

Figure 5:
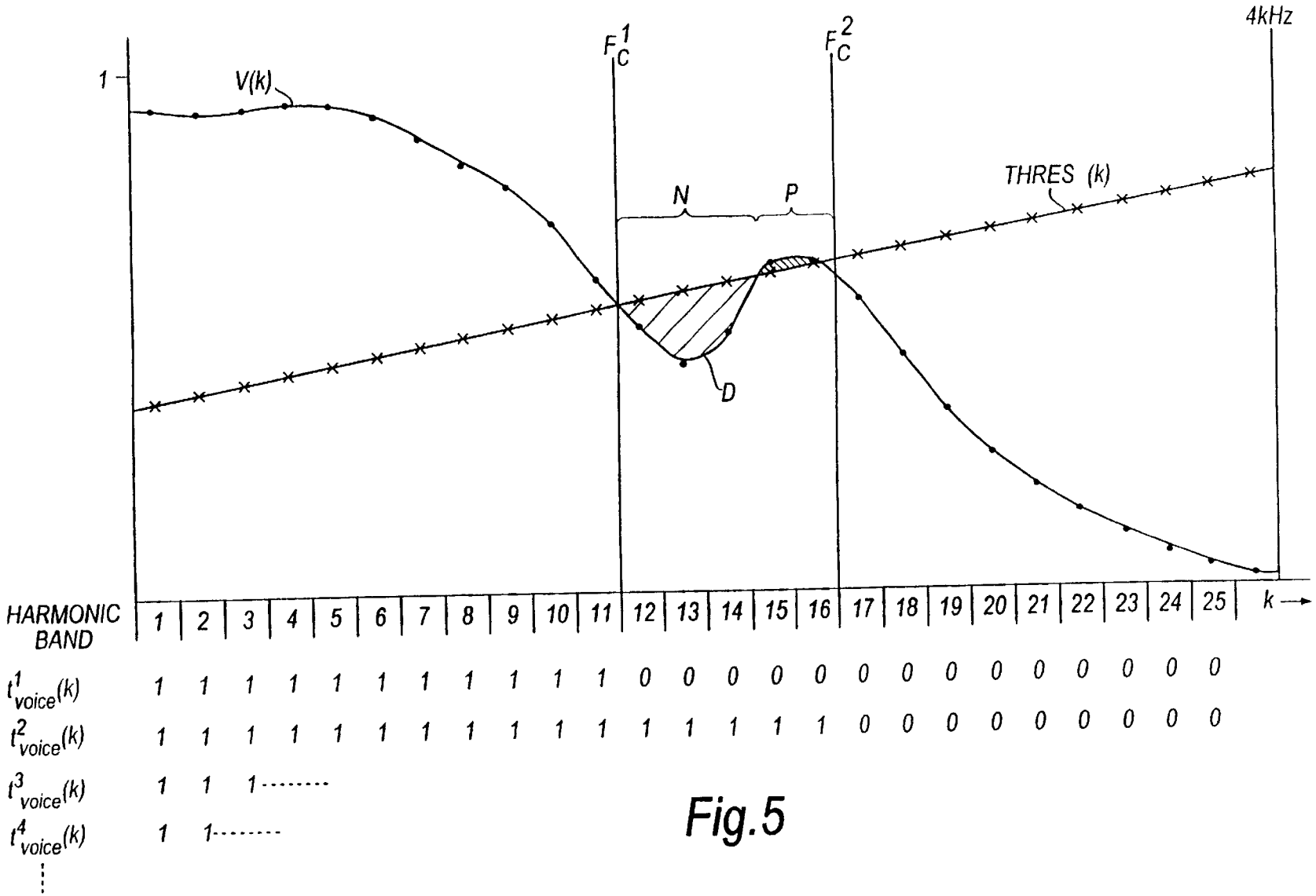
FIG. 5 illustrates the determnination of voicing cut-off frequency.

As will now be described with reference to FIG. 5, the actual frequency spectrum derived from DFT block 20 is analysed in a voicing block 23 to set a voicing cut-off frequency $F_c$ which divides the spectrum into two parts; a voiced part below the voicing cut-off frequency $F_c$, which is the periodic component of speech and an unvoiced part which is the random component of speech.

Once the voiced and unvoiced parts of the spectrum have been separated in this way, they can be independently processed in the decoder without the need to generate and transmit information about the voiced/unvoiced status of each individual harmonic band.

Each harmonic band is centred on a multiple k of a fundamental frequency $\omega_o$, given by $$\frac{2\pi}{P_{ref}}.$$

Initially, the shape of each harmonic band is correlated with the ideal harmonic shape for the band (assuming it to be voiced) given by the Fourier transform of the selected variable length window 21. This is done by generating a correlation function $S_1$ for each harmonic band. For the $k^{th}$ harmonic band, $$S_1(k) = \sum_{a=a_k}^{a=b_k} M(a)W(m), \rightarrow 2$$

where M(a) is the complex value of the spectrum at position a In the FFT, $a_k$ and $b_k$ are the limits of the summation for the band, and W(m) is the corresponding magnitude of the ideal harmonic shape for the band, derived from the selected window, m being an integer defining the position in the ideal harmonic shape corresponding to the position a in the actual harmonic band, which is given by the expression:

$$m = \left|\text{integer}\left(Sbt\cdot\left(a - k\frac{SF}{P_{ref}}\right)\right)\right|, \rightarrow 3$$

where SF is the size of the FFT and Sbt is an up-sampling ratio, i.e. the ratio of the number of points in the window to the number of points in the FFT.

In addition to $S_1$, two normalisation functions $S_2$ and $S_3$ are generated, where $$S_2(k) = \sum_{a=a_k}^{a=b_k} [M(a)]^2,$$

and $$S_3(k) = \sum_{a=a_k}^{a=b_k} [W(m)]^2,$$

These three functions $S_1(k)$,$S_2(k)$ and $S_3(k)$ are then combined to generate a normalised correlation function V(k) given by, $$V(k) = \left[\frac{S_1^2(k)}{S_2(k) \cdot S_3(k)}\right]$$

where k is the number of harmonic bands. V(k) is further biassed by raising it to the power of $$1 + \frac{3(k-10)}{40}.$$

If there is exact correlation between the actual and the ideal harmonic shapes, the value of V(k) will be unity. FIG. 5 shows the form of a typical normalised correlation function V(k) for the case of a frequency spectrum for which the total number K of harmonic bands is 25 (i.e. k=1 to 25). As shown in this Figure, the harmonic bands at the low frequency end of the spectrum are relatively close to unity and are therefore likely to be voiced.

In order to set a value for $F_c$, the function V(k) is compared with a corresponding threshold function THRES (k) at each value of k. The form of a typical threshold function THRES(k) is also shown in FIG. 5.

In order to compute THRES(k) the following values are used:

E–lf, E–hf, tr–E–lf, tr–E–hf, ZC, $L_1$,$L_2$,PKY1, PKY2, $T_1$,$T_2$. These are defined as follows:

$$E-lf = \sum_{i=0}^{\frac{1}{2}SF-1} M^2(i)$$

$$E-hf = \sum_{i=SF/2}^{SF-1} M^2(i)$$

If ($E_u^n$<2 $E_{BG}^n$) and the frame counter is less than 20, $tr^n$–E–lf=0.9$tr^{n-1}$–E–lf+0.1$E^n$–lf, and $tr^n$–E–hf=0.9$tr^{n-1}$–E–lf+0.1$E^n$–hf, Otherwise, if ($E_o^n$<1.5 $E_{BG}^n$), $tr^n$–E–lf=0.97$tr^{n-1}$–E–lf+0.03$E^n$–lf, and $tr^n$–E–hf=0.97$tr^{n-1}$–E–hf+0.03$E^n$–hf.

Also, $tr^o$–E–hf=$10^8$, and $tr^o$–E–lf=$10^7$.

ZC is set to zero, and for each i between –N/2 and N/2

ZC=ZC+1 if $ip[i] x\ ip[i-i]<O$, where ip is input speech referenced so that ip [0] corresponds to the input sample lying in the centre of the window used to obtain the spectrum for the current frame.

$$L_1 = \frac{1}{N}\sum_{i=-N/2}^{N/2-1} |\text{residual}(i)|, \text{ and}$$

$$L_2 = \left[\frac{1}{N}\sum_{i=N/2}^{N/2-1} (\text{residual}(i))^2\right]^{\frac{1}{2}},$$

where residual (i) is an LPC residual signal generated at the output of a LPC inverse filter 28, and referenced so that residual (0) corresponds to ip(o).

PKY1=L2/L1 and $$PKY2 = \frac{L2'}{L1'},$$

where L1',L2' are calculated as for L1,L2 respectively, but excluding a predetermined number of values to either side of the maximum residual value averaged over a correspondingly reduced number of terms. PKY1 and PKY2 are both indications of the "peakiness" of the residual speech, but PKY2 is less sensitive to exceptionally large peaks.

$$T_1 = \sum_{i=-N/2}^{N/2-1} |ip[i] - ip[i-1]|,$$

$$T_2 = \sum_{i=-N/2}^{N/2-1} |ip[i]|$$

If (NRGS<30×NRGB) i.e. noisy background conditions prevail, and if (E–lf>tr–E–If) and (E–hf>tr–E–hf), then a low-to-high frequency energy ratio (LH–Ratio) is given by the expression $$LH-Ratio = \frac{E-lf-0.9tr-E-lf}{E-hf-0.9tr-E-hf},$$

and if (E–lf<tr–E–lf), then

LH–Ratio=0.02, and if E–hf<tr–E–hf, then

LH–Ratio=1.0, and LH–Ratio is clamped between 0.02 and 1.0.

In these noisy background conditions, two different situations exist; namely, case 1 where the threshold value THRES(k) in the immediately preceding frame lay below the cut-off frequency $F_c$ for that frame, and case 2 wherein the threshold value THRES(k) in the immediately preceding frame lay above the cut-off frequency $F_c$ for that frame.

If (LH–Ratio<0.2), then for Case 1,

THRES($k$)=1.0–½(1.0–⅛($k$–1)$\omega_o$), and for Case 2

THRES($k$)=1.0–⅓(1.0–⅛($k$–1)$\omega_o$), and these values are then modified as follows:

THRES($k$)=1.0–(1.0–THRES($k$))($LH$–Ratio×5)$^{1/2}$.

If LH–Ratio>0.2, then for Case 1,

THRES($k$)=1.0–½(1.0–⅛($k$–1)$\omega_o$×0.125), and for case 2,

THRES($k$)=1.0–⅓(1.0–⅛($k$–1)$\omega_o$×0.125) and if (LH–Ratio≧1.0) these values are modified as follows:

THRES($k$)=1–(1–THRES($k$))$^{1/2}$.

Defining an energy ratio, $$ER = 2.0\frac{E_0}{E_0 + Emax},$$

where $E_o$ is the energy of the entire frequency spectrum, given by $$E_0 = \sum_{1=0}^{SF-1} (M(i))^2$$

and Emax is an estimate of the maximum energy encountered in recent frames (where ER is set at 0.1 if ER<0.1), then if (ER<0.4), the above threshold values are further modified as follows:

$$THRES(k)=1.0-(1.0-THRES(k))\ (2.5\ ER)^{1/2}, \text{ and}$$

if (ER>0.6), the threshold values are further modified as follows:

$$THRES(k)\ 1.0-(1.0-THRES(k))^{1/2}.$$

Furthermore, if (THRES(k)>0.85), these modified values are subjected to a yet further modification as follows:

$$THRES(k)=0.85+\tfrac{1}{2}(THRES(k)-0.85).$$

Finally, if $\tfrac{3}{4}K \leqq k \leqq K$, then the values of THRES(k) are modified still further as follows:

$$THRES(k)=1.0-\tfrac{1}{2}(1.0-THPES(k)).$$

In clean background conditions (i.e. NRGS>30.0 NRGB) then for Case 1, $$THRES(k)=1.0-0.6(1.0-\tfrac{1}{n}(k-1)\times 0.25),$$

and for Case 2, $$THRES(k)=1.0-0.45(1.0-\tfrac{1}{n}(k-1)\times 0.25),$$

These values then undergo successive modifications according to the following conditions:

(i) if (E−lf/E−hf<2.0), then $$THRES(k)=1-(1-THRES(k))\left(\frac{E-1f}{2.0E-hf}\right)$$

(ii) if ($T_2/T_1$<1), then $$THRES(k)=1-(1-THRES(k))\left(\frac{T_2}{T_1}\right)^2$$

(iii) if ($T_2/T_1$>1.5), then $$THRES(k)=1-(1-THRES(k))^{1/2},$$

(iv) if (ZC>60), then $$THRES(k)=1-(1-THRES(k))\left(\frac{60}{ZC}\right)^2$$

(v) if (ER<0.4), then $$THRES(k)=1-2.5\ ER\ (1-THRES(k))$$

(vi) if (ER>0.6), then $$THRES(k)=1-(THRES(k))^{1/2}, \text{ and finally}$$

(vii) if (THRES(k)>0.5), then $$THRES(k)=1-1.6\ (1-THRES(k)), \text{ otherwise}$$

$$THRES(k)=0.4\ THRES(K).$$

The input speech is low-pass filtered and the normalised cross-correlation is then computed for integer lag values $P_{ref}-3$ to $P_{ref}+3$, and the maximum value of the cross-correlation CM is determined.

The value of THRES(k) derived above for noisy and clean background conditions are then further modified according to the first condition to be satisfied in the following hierachy of conditions:

1. If (PKY1>1.8) and (PKY2>1.7), $$THRES(k)=0.5\ THRES(k).$$

2. If (PKY1>1.7) and (CM>0.35), $$THRES(k)=0.45\ THRES(k).$$

3. If (PKY1>1.6) and (CM>0.2), $$THRES(k)=0.55\ THRES(k).$$

4. If (CM>0.85) or (PKY1>1.4 and CM>0.5) or (PKY1>1.5 and CM>0.35), $$THRES(k)=0.75\ THRES(k).$$

5. If (CM<0.55) and (PKY1<1.25), $$THRES(k)=1-0.25\ (1-THRES(k))$$

6. If (CM<0.7) and PKY1<1.4, $$THRES(k)=1-0.75\ (1-THRES(k)).$$

Finally, if (E−OR>0.7) and (ER<0.11) or if (ZC>90), then $$E-OR = \frac{\sum_{i=-N/2}^{N/2-1} residual^2(i)}{\sum_{i=-N/2}^{N/2-1} ip^2(i)}$$

A summation $S_v$ is then formed as follows:

$$S_v=\Sigma_{k-1}^{k}(V(k)-THRES(k))(2t_{voice}(k)-1)\times B(k)$$

where B(k)=5$S_3$, if V(k)>THRES(k), otherwise B(k)=$S_3$, and $t_{voice}$(k) takes either the value "1" or the value "0".

In effect, the values $t_{voice}$(k) define a trial voicing cut-off frequency $F_c$ such that $t_{voice}$(k) is "1" at all values of k below $F_c$ and is "0" at all values of k above $F_c$. FIG. 5 shows a first set of values $t^1_{voice}(k)$ defining a first trial cut-off frequency $F^1_c$, and a second set of values $t^2_{voice}(k)$ defining a second trial cut-off frequency $F^2_c$. In this embodiment, the summation $S_v$ is formed for each of eight different sets of values $t^1_{voice}(k), t^2_{voice}(k) \ldots t^8_{voice}(k)$, each defining a different trial cut-off frequency $F^1_c, F^2_c \ldots F^8_c$. The set of values giving the maximum summation $S_v$ will determine the voicing cut-off frequency for the frame.

It will be appreciated that the effect of the function $(2t_{voice}(k)-1)$ in the above summation is to reverse the sign of the difference value (V(k)−THRES(k)) whenever $t_{voice}(k)$ has the value "0", i.e. at values of k above the cut-off frequency. In the example shown in FIG. 5, the effect of the function $(2t_{voice}(k)-1)$ is to determine whether the voicing cut-off frequency $F_c$ should be set at a value $F^1_c$ which is below dip D in the correlation function V(k) or at a higher value $F^2_c$ above the dip. In the range of k referenced N in FIG. 5, the value V(k) is less than the value THRES(k) and so the difference value (V(k)−THRES(k)) in the summation $S_v$ is negative. If the first set of values $t^1_{voice}(k)$ is used their effect is to reverse the sign of (V(k)−THRES(k)) in the range N, resulting in a positive contribution to the overall summation.

In contrast if the second set of values $t^2_{voice}(k)$ is used their effect is to maintain unchanged the sign of (V(k)−THRES(k)) in the range N, resulting in a negative contribution to the overall summation. In the range of k referenced P in FIG. 5, the opposite will be the case; that is, the first set of values $t^1_{voice}(k)$ will result in a negative contribution to the summation for the range, whereas the second set of values $t^2_{voice}(k)$ will result in a positive contribution to the summation. However, as will be apparent from the relative areas of the respective cross-hatched regions in FIG. 5, the effect of the difference values (V(k)−THRES(k)) in range N is much greater than in range P and so, in this example, the first set of values $t^1_{voice}(k)$ will give the maximum summation $S_v$, and would be used to determine the voicing cut-off frequency ($F^1_c$) for the frame.

Having selected a value of $F_c$ from the eight possible values, the corresponding index (1 to 8) provides the voicing quantisation index V which is routed to a third output $O_3$ of the encoder via voicing quantiser 24. The quantisation index V is defined by three bits corresponding to the eight possible frequency levels.

Having established values for pitch, $P_{ref}$ and voicing cut-off frequency, $F_c$ for the current frame, the spectral amplitude of each harmonic band is evaluated in amplitude determination block 25. The spectral amplitudes are derived from a frequency spectrum produced by performing a discrete Fourier transform in block 27 (implemented as a Fast Fourier Transform) on a windowed LPC residual signal generated at the output of LPC inverse filter 28. Filter 28 is supplied with the original input speech signal and with a set of regenerated LPC coefficients generated by dequantising the LSF quantisation indices in LSF dequantiser 29 and transforming the dequantised LSF values in an LSF-LPC transformer 30.

If an harmonic band (the $k^{th}$ band say) lies in the unvoiced part of the frequency spectrum; that is, it lies above the voicing cut-off frequency $F_c$, the spectral amplitude amp(k) of the band is given by the RMS energy in the band, expressed as $$\mathrm{amp}(k) = \left[\frac{\sum_{a=a_k}^{a=b_k} |M_r(a)|^2}{b_k - a_k}\right]^{\frac{1}{2}} \beta,$$

where $M_r(a)$ is the complex value at position a in the frequency spectrum derived from LPC residual signal calculated as before from the real and imaginary parts of the FFT, and $a_k$ and $b_k$ are the limits of the summation for the $k^{th}$ band, and β is a normalisation factor which is a function of the window.

If, on the other hand, the harmonic band lies in the voiced part of the frequency spectrum; that is, it lies below the voicing cut-off frequency $F_c$ the spectral amplitude amp(k) for the $k^{th}$ band is given by the expression $$\mathrm{amp}\ (k) = \left[\frac{\left|\sum_{a=a_k}^{a=b_k} M_r(a)W(m)\right|}{\sum_{a=a_k}^{a=b_k} [W(m)]^2}\right]^{\frac{1}{2}}$$

where W(m) is as defined with reference to Equations 2 and 3 above.

The spectral amplitudes obtained in this way are normalised to have unity mean.

The normalised spectral amplitudes are then quantised in amplitude quantiser 26. It will be appreciated that this may be done using a variety of different quantisation schemes depending upon the number of available bits. In this particular embodiment, a vector quantisation process is used and reference is made to the LPC frequency spectrum P(ω) for the frame. The LPC frequency spectrum P(ω) represents the frequency response of the LPC filter 12 and has the form $$P(\omega) = \frac{1}{1 - \sum_{l=1}^{L} LPC(l)e^{-j\omega l}}$$

where LPC(1) are the LPC coefficients. In this embodiment there are 10 LPC coefficients, i.e. L=10.

Figure 6:
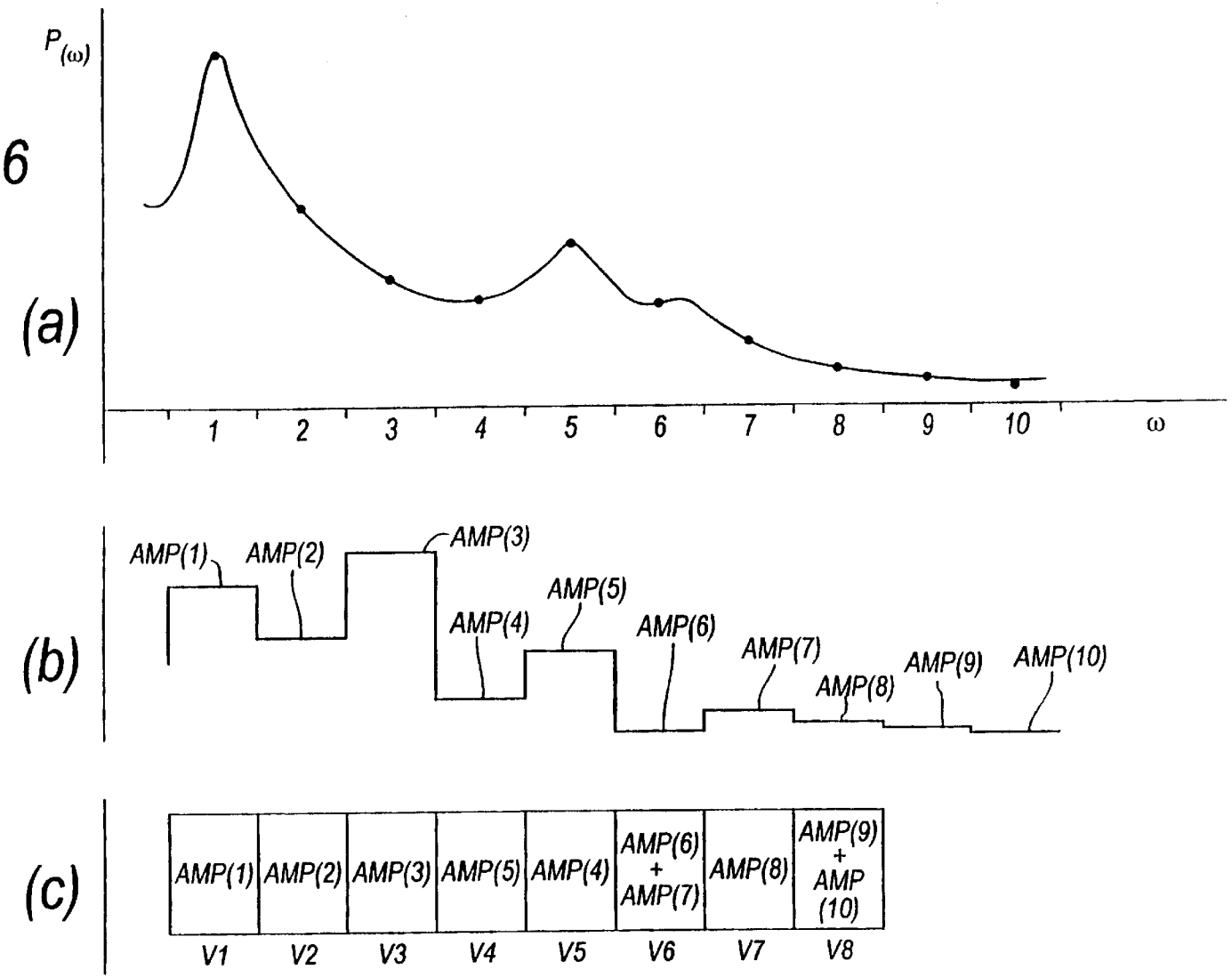
FIG. 6(*a*) shows an LPC Spectrum for a frame.

The LPC frequency spectrum P(ω) is shown in FIG. 6*a* and the corresponding spectral amplitudes amp(k) are shown in FIG. 6*b*. In this example, only 10 harmonic bands (k=1 to 10) are shown.

The LPC frequency spectrum is examined to find four harmonic bands containing the highest magnitudes and, in this illustration, these are the harmonic bands for which k=1,2,3 and 5. As illustrated in FIG. 6*c*, the corresponding spectral amplitudes amp(1),amp(2),amp(3),amp(5) form the first four elements V(1),V(2),V(3),V(4) of an eight element vector, and the last four elements of the vector (V(5) to V(8)) are formed from the six remaining spectral amplitudes, amp(4) and amp(6) to amp(10), by appropriate averaging. To this end, element V(5) is formed by amp(4), element V(6) is formed by the average of amp(6) and amp(7), element V(7) is formed by amp(8) and element V(8) is formed by the average of amp(9) and amp(10).

The vector quantisation process is carried out with reference to the entries in a codebook, and the entry which best matches the assembled vector (using a mean squared error measure weighted by the LPC spectral shape) is selected as the first part S1 of an amplitude quantisation index S for the frame.

In addition, a second part S2 of the amplitude quantisation index S is computed as the RSM energy $R_m$ of the original speech input of the frame.

The first part of the amplitude quantisation index S1 represents the "shape" of the frequency spectrum, whereas the second part of the amplitude quantisation index S2 represents the scale factor related to the volume of the speech signal. In this embodiment, the first part of the index S1 consists of 6 bits (corresponding to a codebook containing 64 entries, each representing a different spectral "shape") and the second part of the index S2 consists of 5 bits. The two parts S1,S2 are combined to form a 11 bit amplitude quantisation index S which is forwarded to a fourth output $O_4$ of the encoder.

Depending upon the number of available bits a variety of different schemes can be used to quantize the spectral amplitude. For example, the quantisation codebook could contain a larger or smaller number of entries, and each entry may comprise a vector consisting of a larger or smaller number of amplitude values.

As will be described hereinafter, the decoder operates on the indices S, P and V to synthesise the residual signal whereby to generate an excitation signal which is supplied to the decoder LPC synthesis filter.

In summary, the encoder generates a set of quantisation indices LPC, ES, Y, S1 and S2 for each frame of the input speech signal.

The encoder bit rate depends upon the number of bits used to define the quantisation indices and also upon the update rate of the quantisation indices.

In the described example, the update period for each quantisation index is 20 ms (the same as the frame update period) and the bit rate is 2.4 kb/s. The number of bits used for each quantisation index in this example is summarised in Table 1 below.

The LSF coefficients (LSF2,LSF3) for the leading and trailing halves of the current 40 ms frame are quantised with reference to each other and with reference to the LSF coefficients (LSF1) for the trailing half of the immediately preceding frame and the corresponding LSF quantisation vector.

Target quantised LSF coefficients (LSF'1, LSF'2, LSF'3) for each half frame are given by the sum of a respective prediction value (P1, P2, P3) for that half frame and a respective LSF quantisation vector (Q1, Q2, Q3) contained in a vector quantisation codebook, where $$LSF'1=P1+Q1,$$

$$LSF'2=P2+Q2, \text{ and}$$

$$LSF'3=P3+Q3.$$

Each prediction value P2, P3 is obtained from the respective LSF quantisation vector Q1, Q2 for the immediately preceding half frame, such that:

$$P2=\lambda Q1, \text{ and}$$

$$P3=\lambda Q2,$$

where $\lambda$ is a constant prediction factor, typically in the range from 0.5 to 0.7.

To reduce the bit rate, it is useful to define the target quantised LSF coefficients LSF'2 (for the leading half of the current frame) in terms of the target quantised LSF coefficients (LSF'1, LSF'3) for the adjacent half frames. Thus, $$LSF'2'\alpha LSF'1+(1-\alpha)LSF'3, \qquad \rightarrow \text{Eq 4}$$

where $\alpha$ is a vector of 10 elements in a sixteen entry codebook represented by a 4-bit index.

TABLE 1

| BIT RATE (kb/s) | | 2.4 | 1.2 | | 3.9 | | 4.0 | | 5.2 | | 6.8 | |
|---|---|---|---|---|---|---|---|---|---|---|---|---|
| UP-DATE PERIOD | | 20 | 40 | | 20 | | 20 | | 20 | | 20 | |
| (ms) | | | 20 | 20 | 10 | 10 | 10 | 10 | 10 | 10 | 10 | 10 |
| NO OF BITS | LPC | 24 | 4 | 24 | 28 | | 20 | 20 | 28 | | 28 | 28 |
| | P | 7 | 7 | | 7 | 5 | 7 | 5 | 7 | 5 | 7 | 7 |
| | V | 3 | 3 | | 4 | 4 | 3 | 3 | 4 | 4 | 5 | 5 |
| | S1 | 6 | 0 | | 8 | 8 | 6 | 6 | 21 | 21 | 21 | 21 |
| | S2 | 5 | 5 | 5 | 7 | 7 | 5 | 5 | 7 | 7 | 7 | 7 |
| NO OF BITS/FRAME | | 45* | 48 | | 78 | | 80 | | 104 | | 136 | |

*Three additional bits (giving a total of 48 bits) can either be used for better quantisation of parameters or for synchronisation and error protection.

Table 1 also summarises the distribution of bits amongst the quantisation indices in each of five further examples, in which the speech encoder operates at 1.2 kb/s, 3.9 kb/s, 4.0 kb/s, 5.2 kb/s and 6.8 kb/s respectively.

In some of these examples, some or all of the quantisation indices are updated at 10 ms intervals, i.e. twice per frame. It will be noted that in such cases the pitch quantisation index P derived during the first 10 ms update period in a frame may be defined by a greater number of bits than the pitch quantisation index P derived during the second 10 ms update period. This is because the pitch value derived during the first update period is used as a basis for the pitch value derived during the second update period, and so the latter pitch value can be defined using fewer bits.

In the case of the 1.2 kb/s rate, the frame length is 40 ms. In this case, the pitch and voicing quantisation indices P, V are determined for one half of each frame, and the indices for another half of the frame are obtained by extrapolation from the respective parameters in adjacent half frames.

By substitution of the foregoing equations it can be shown that $$LSF'3\ (1-\lambda-\lambda\alpha)=Q3+\lambda\alpha LSF'1-\lambda^2 Q1 \qquad \rightarrow \text{Eq 5}$$

The only variables in equations 4 and 5 above are the vectors $\alpha$ and Q3, and these vectors are varied to minimise an error function $\epsilon$ (which may be perceptually weighted) given by $$\epsilon=(LSF'3-LSF3)^2+(LSF'2-LSF2)^2,$$

which represents a measure of distortion between the actual and quantised LSF coefficients in the current frame.

The respective codebooks are searched to discover the combination of vectors $\alpha$ and Q3 giving the minimum error function $\epsilon$, and the selected entries in the codebooks respectively define 4 and 24 bit components of a 28 bit LSF quantisation index for the current frame. In a manner similar to that described earlier with reference to the 2.4 kb/s encoder, the LSF quantisation vectors contained in the vector quantisation codebook consist of three groups each containing $2^8$ entries, numbered 1 to 256, which correspond to the first three, the second three and the last four LSF coefficients. The selected entry in each group defines an eight bit quantisation index, giving a total of 24 bits for the three groups.

The speech coder described with reference to FIGS. 3 to 6 may operate at a single bit rate. Alternatively, the speech coder may be an adaptive multi-rate (AMR) coder selectively operable at any one of two or more different bit rates. In a particular implementation of this, the AMR coder is selectively operable at any one of the aforementioned bit rates where, again, the distribution of bits amongst the quantisation indices for each rate is summarised in Table 1.

Figure 7:
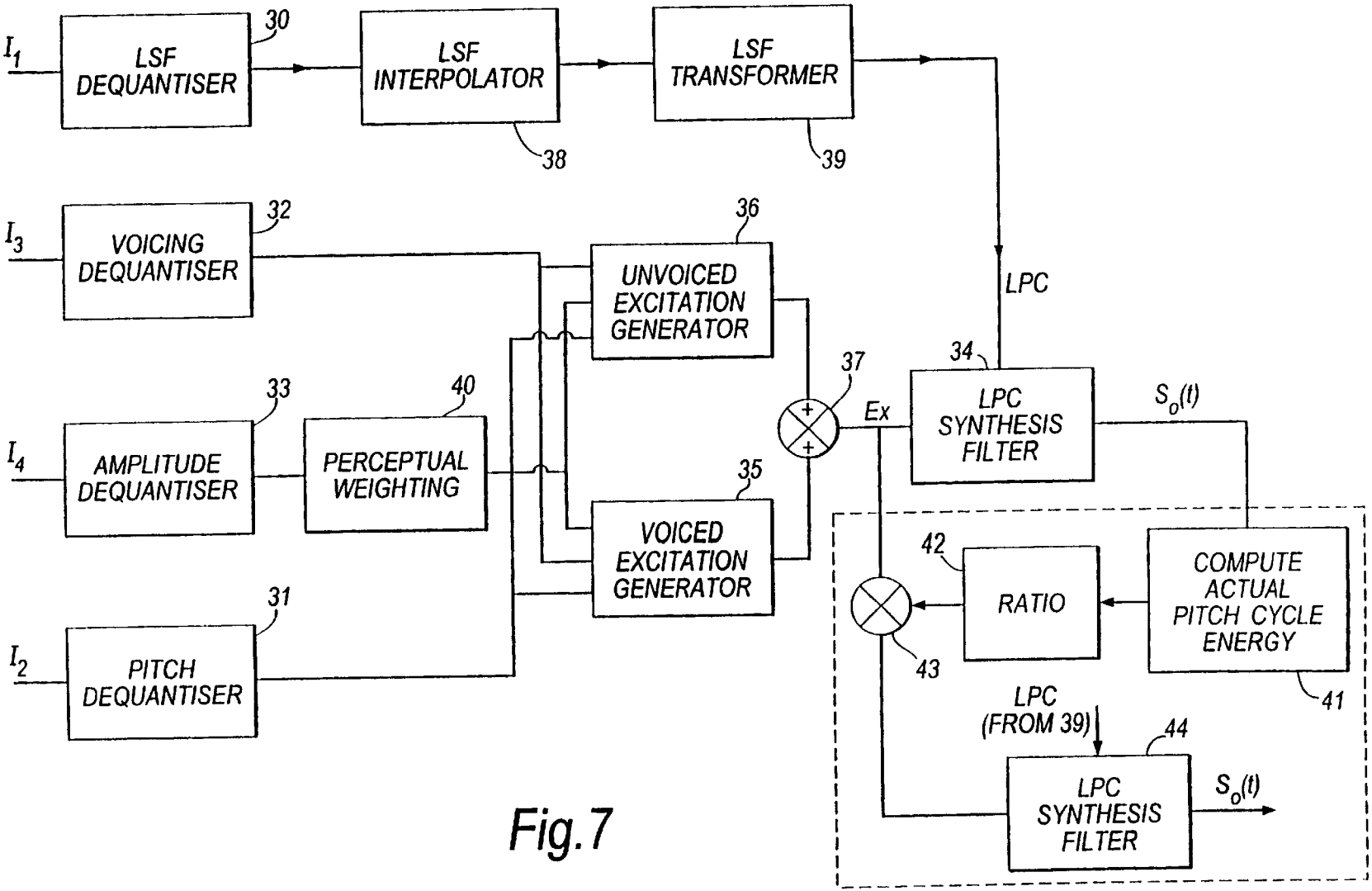
FIG. 7 shows the decoder of the speech coder.

The quantisation indices generated at outputs $O_1$,$O_2$,$O_3$ and $O_4$ of the speech encoder are transmitted over the communications channel to the decoder, shown in FIG. 7. In the decoder the quantisation indices are regenerated and are supplied to inputs $I_1$,$I_2$,$I_3$ and $I_4$ of dequantisation blocks 30,31,32 and 33 respectively.

Dequantisation block 30 outputs a set of dequantised LSF coefficients for the frame and these are used to regenerate a corresponding set of LPC coefficients which are supplied to an LPC synthesis filter 34.

Dequantisation blocks 31,32 and 33 respectively output dequantised values of pitch ($P_{ref}$), voicing cut-off frequency ($F_c$) and spectral amplitude (amp(k)) together with the RMS energy $R_m$, and these values are used to generate an excitation signal $E_x$ for the LPC synthesis filter 34. To this end, the values $P_{ref}$, Fc, amp(k) and $R_m$ are supplied to a first excitation generator 35 which synthesises the voiced part of the excitation signal (i.e. the part containing frequencies below $F_c$) and to a second excitation generator 36 which synthesises the unvoiced part of the excitation signal (i.e. the part containing frequencies above $F_c$).

The first excitation generator 35 generates a respective sinusoid at the frequency of each harmonic band; that is at integer multiples of the fundamental pitch frequency $$\omega_0 = \left(\frac{2\pi}{P_{ref}}\right)$$

up to the voicing cut-off frequency $F_c$. To this end, the first excitation generator 35 generates a set of sinusoids of the form $A_k\cos(k\theta)$, where k is an integer.

Using the dequantised pitch value (Pref), the beginning and end of each pitch cycle within the synthesis frame is determined, and for each pitch cycle a new set of parameters is obtained by interpolation.

The phase θ(i) at any sample i is given by the expression $$\theta(i)=\theta(i-1)+2\pi[\omega_{last}(1-x)+\omega_o x],$$

where $\omega_{last}$ is the fundamental pitch frequency determined for the immediately preceding frame, and $$x = \frac{k}{F}$$

where F is the total number of samples in a frame, and k is the sample position of the middle of the current pitch cycle being synthesised in the current frame.

The term $\omega_{last}(1-x)+\omega_o \cdot x$ in the above expression causes a progressive shift in the phase, pitch cycle-by-pitch cycle, to ensure a smooth phase transition at the frame boundaries. The amplitude $A_k$ of each sinusoid is related to the product amp(k). $R_m$ for the current frame; however, interpolation between the amplitudes of the current and immediately preceding frames carried out on a pitch cycle-to-pitch cycle basis may be applied, as follows:

(i) If an harmonic frequency band lies in the unvoiced part of the frequency spectrum in the current frame but lay in the voiced part of the frequency spectrum in the immediately preceding frame it is assumed that the speech signal is tailing off. In this case, a sinusoid is still generated by excitation generator 35 for the current frame, but using the amplitude of the earlier frame, scaled down by a suitable ramping factor (which is preferably held constant over each pitch cycle) over the length of the current frame.

(ii) If an harmonic frequency band lies in the voiced part of the frequency spectrum in the current frame but lay in the unvoiced part of the frequency spectrum in the immediately preceding frame it is assumed that there is an onset in the speech signal. In this case, the amplitude of the current frame is used, but scaled up by a suitable ramping factor (which, again, is preferably held constant over each pitch cycle) over the length of the frame.

(iii) If an harmonic frequency band lies in the voiced part of the frequency spectrum in both the current and the immediately preceding frames, normal speech is assumed. In this case, the amplitude is interpolated between the current and previous amplitude values over the length of the current frame.

Alternatively, voiced part synthesis can be implemented by an inverse DFT method, where the DFT size is equal to the interpolated pitch length. In each pitch cycle the input to the DFT consists of the decoded and interpolated spectral amplitudes up to the point of the interpolated cut-off frequencies $F_c$, and zeros thereafter.

The second excitation generator 36 used to synthesise the unvoiced part of the excitation signal includes a random noise generator which generates a white noise sequence. An "overlap and add" technique is used to extract from this sequence a series of $P_{ref}$ samples corresponding to the current interpolated pitch cycle. This is accomplished using a trapezoidal window having an overall width of 256 samples and which is slid along the white noise sequence, frame-by-frame, in steps of 160 samples. The windowed samples are subjected to a 256-point fast Fourier transform and the resultant frequency spectrum is shaped by the dequantised spectral amplitudes. In the frequency range above $F_c$, each harmonic band, k, in the frequency spectrum is shaped by the dequantised and scaled spectral amplitude $R_m$amp(k) for the band, and in the frequency range below $F_c$ (which corresponds to the voiced part of the spectrum) the amplitude of each harmonic band is set to zero. An inverse Fourier transform is then applied to the shaped frequency spectrum to produce the unvoiced excitation signal in the time domain. The samples corresponding to the current pitch cycle are then used to form the unvoiced excitation signal. The use of an "overlap and add" technique enhances the smoothness of the decoded speech signal.

The voiced excitation signal generated by the first excitation generator 35 and the unvoiced excitation signal generated by the second excitation generator 36 are added together in adder 37 and the combined excitation signal Ex is output to the LPC synthesis filter 34. The LPC synthesis filter 34 receives interpolated LPC coefficients derived from the decoded LSF coefficients and uses these to filter the combined excitation signal to synthesise the output speech signal $S_o(t)$.

In order to generate a smooth output speech signal $S_o(t)$ any change in the LPC coefficients should be gradual, and so interpolation is desirable. It is not possible to interpolate between LPC coefficients directly; however, it is possible to interpolate between LSF coefficients.

If consecutive frames are completely filled with speech so that the RMS energies in the frame are substantially the same, the two sets of LSF coefficients for the frames are not too dissimilar and so a linear interpolation can be applied between them. However, a problem would arise if a frame contains speech and silence; that is, the frame contains a speech onset or a speech tail-off. In this situation, the LSF coefficients for the current frame and the LSF coefficients for the immediately preceding frame would be very different and so a linear interpolation would tend to distort the true speech pattern resulting in noise.

In the case of a speech onset, the RMS energy $E_c$ in the current frame is greater than the RMS energy $E_p$ in the immediately preceding frame, whereas in the case of speech tail-off the reverse is true.

Figure 8:
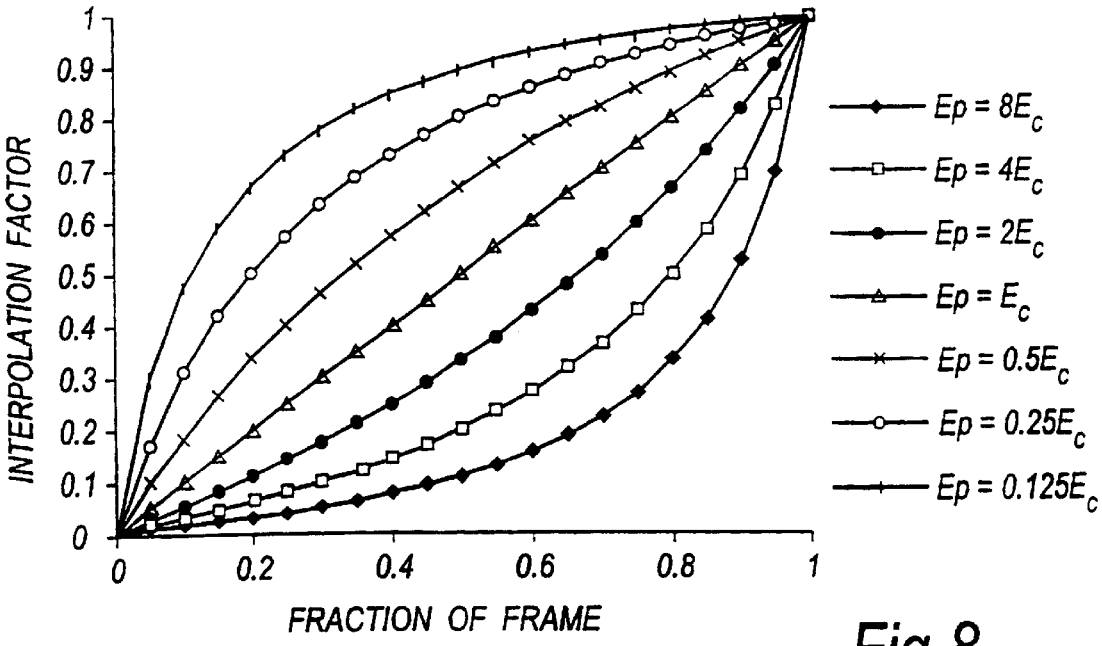
FIG. 8 illustrates an energy-dependent interpolation factor for the LSF coefficients.

With a view to alleviating this problem an energy-dependent interpolation is applied. FIG. 8 shows the variation of interpolation factor across the frame for different ratios $$\frac{E_p}{E_c}$$

ranging from 0.125 (speech onset) to 8.0 (speech tail-off). It can be seen from FIG. 8, that the effect of the energy-dependent interpolation factors is to impose a bias toward the more significant set of LSF coefficients so that voiced parts of the frame are not passed through a filter more appropriate to background noise.

The interpolation procedure is applied to the LSF coefficients in LSF Interpolator 38 and the interpolated values so obtained are passed to a LSF-LPC Transformer 39 where the corresponding LPC coefficients are generated.

In order to enhance speech quality it has been customary, hitherto, to perform post-processing on the synthesised output speech signal to reduce the effect of noise in the valleys of the LPC frequency spectrum, where the LPC model of speech is relatively poor. This can be accomplished using suitable filters; however, such filtering induces some spectral tilt which muffles the final output signal and so reduces speech quality.

In this embodiment, a different technique is used; more specifically, instead of processing the output of the LPC synthesis filter 34, as has been done in the past, the technique used in this embodiment relies on weighting the spectral amplitudes generated at the output of decoder block 33. The weighting factor $Q(k\omega_o)$ applied to the $k^{th}$ spectral amplitude is derived from the LPC spectrum $P(\omega)$ described earlier. LPC spectrum $P(\omega)$ is peak-interpolated to generate a peak-interpolated spectrum $H(\omega)$, and the weighting function $Q(\omega)$ is given by the ratio of $P(\omega)$ and $H(\omega)$, raised to the power $\lambda$; that is:

$$Q(\omega) = \left[\frac{P(\omega)}{H(\omega)}\right]^{\lambda}$$

where $\lambda$ is in the range from 0.00 to 1.0 and is preferably 0.35.

Figure 9:
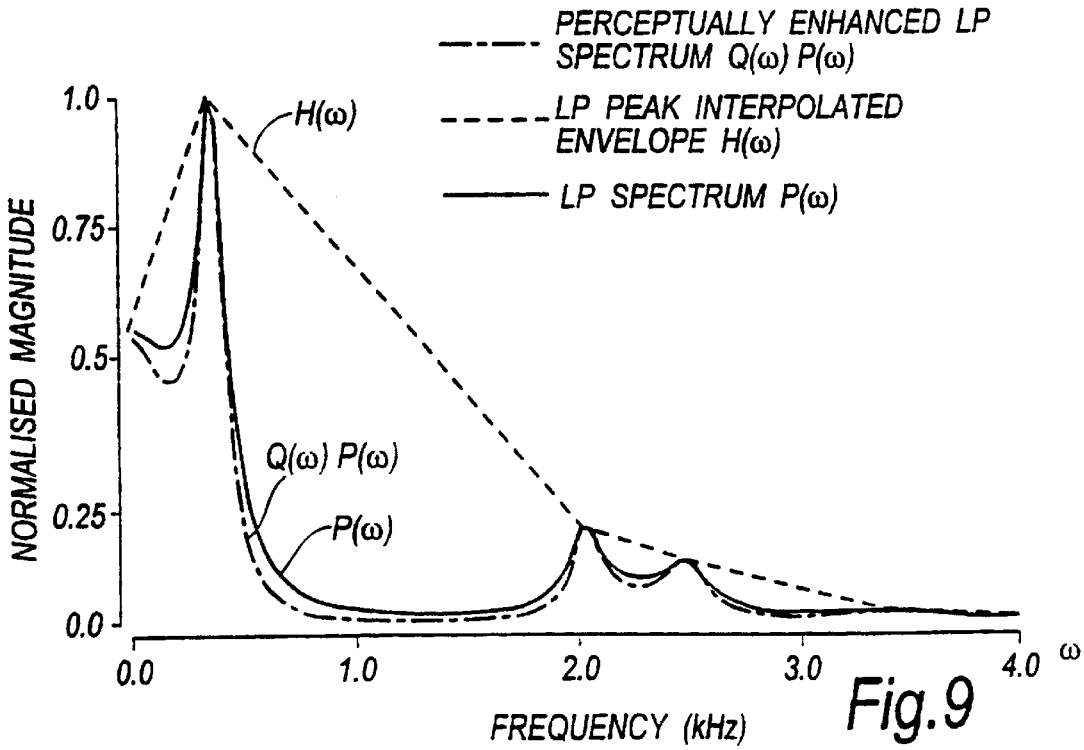
FIG. 9 illustrates a perceptually-enhanced LPC spectrum used to weight the dequantised spectral amplitudes.

The functions $P(\omega)$ and $H(\omega)$ are shown in FIG. 9 along with the perceptually-enhanced LPC spectrum given by $Q(\omega))P((\omega)$.

As can be seen from this Figure, the effect of the weighting function $Q((\omega)$ is to reduce the value of the LPC spectrum in the valley regions between peaks, and so reduce the noise in these regions. When the appropriate weights $Q(k\omega_o)$ are applied to the dequantised spectral amplitudes amp(k) in perceptual weighting block 40 their effect is to improve the quality of the output speech signal, as though it had been subjected to post-processing, but without causing spectral tilt and the associated muffling associated with the post-processing technique used in the past.

Since the output of the LPC synthesis filter 34 can fluctuate in energy, the output is preferably controlled. This is done in two stages, using the optional circuit shown in broken outline in FIG. 7. In the first stage, the actual pitch cycle energy is computed in block 41 and this energy is compared with the desired interpolated pitch cycle energy in a ratioing circuit 42 to generate a ratio value. The corresponding pitch cycle of the excitation signal $E_x$ is then multiplied by this ratio value in multiplier 43 to reduce a difference between the compared energies and then passed to a further lpc synthesis filter 44 which synthesises the smoothed output speech signal.

What is claimed is:

1. A speech coder including an encoder for encoding an input speech signal divided into frames each consisting of a predetermined number of digital samples, the encoder including:

linear predictive coding (LPC) means for analysing samples and generating at least one set of linear prediction coefficients for each frame;

pitch determination means for determining at least one value of pitch for each frame, the pitch determination means including first estimation means for analysing samples using a frequency domain technique (frequency domain analysis), second estimation means for analysing samples using a time domain technique (time domain analysis) and pitch evaluation means for using the results of said frequency domain and time domain analyses to derive a said value of pitch;

voicing means for defining a measure of voiced and unvoiced signals in each frame, amplitude determination means for generating amplitude information for each frame, and quantisation means for quantising said set of linear prediction coefficients, said value of pitch said measure of voiced and unvoiced signals and said amplitude information to generate a set of quantisation indices for each frame, wherein said first estimation means generates a first measure of pitch for each of a number of candidate pitch values, the second estimation means generates a respective second measure of pitch for each of said candidate pitch values and said evaluation means combines each of at least some of the first measures with the corresponding said second measure and selects one of the candidate pitch values by reference to the resultant combinations.

2. A speech coder as claimed in claim 1, wherein said evaluation means form said combinations by forming a ratio from each said first measure and the corresponding second measure and selects said one candidate pitch value by reference to the ratios so formed.

3. A speech coder as claimed in claim 1, wherein the evaluation means compares each said candidate pitch value with a tracked pitch value derived from one or more earlier frames and weights the corresponding said first and second measures by respective amounts in dependence on the comparison before said measure are combined.

4. A speech coder as claimed in claim 3 wherein the amounts of the weighting depend also on the level of background noise in the current frame.

5. A speech coder as claimed in claim 1 wherein said first estimation means generates a first frequency spectrum for each frame, identifies peaks in the first frequency spectrum, subjects the first frequency spectrum to a smoothing process to generate a smoothed frequency spectrum and for each candidate pitch value correlates peaks identified in said first frequency spectrum with amplitudes at different harmonic frequencies ($k\omega_o$) in the smoothed frequency spectrum to generate a respective said first measure of the pitch value, where $$\omega_0 = \frac{2\pi}{P},$$

P is the candidate pitch value and k is an integer.

6. A speech coder as claimed in claim 5 wherein prior to identification of said peaks, magnitude values forming said first frequency spectrum are compared with a RMS value for the spectrum and are weighted in dependence on the comparison whereby to de-emphasise a peak having a magnitude greater than said RMS value.

7. A speech coder as claimed in claim 6 wherein said magnitude values are further weighted by a factor which increases as a function of decreasing frequency.

8. A speech coder as claimed in claim 7 wherein the magnitudes of said first frequency spectrum are adjusted to take account of background noise in the current frame.

9. A speech coder as claimed in claim 5 wherein prior to correlation, the magnitude of each peak identified in the first frequency spectrum is compared with the corresponding magnitude in the smoothed frequency spectrum and is either discarded or retained in dependence on the comparison.

10. A speech coder as claimed in claim 1 wherein said first estimation means selects a single candidate pitch value for each of a preset number of frequency bands, and said second estimation means generate a said second measure of pitch for each of the candidate pitch values selected by the first estimation means.

11. A speech coder as claimed in claim 1 wherein said selected candidate pitch value provides an estimation of said value of pitch and the said evaluation means includes pitch refinement means for determining the value of pitch from the estimate.

12. A speech coder as claimed in claim 11, wherein the pitch refinement means defines a set of further candidate pitch values including fractional values distributed about said estimate, generates a further frequency spectrum for the frame, identifies peaks in the further frequency spectrum, subjects said further frequency spectrum to a smoothing process to generate a further smoothed frequency spectrum, for each further candidate pitch value correlates peaks identified in the further frequency spectrum with amplitudes at different harmonic frequencies ($k\omega_o$) in the smoothed frequency spectrum, wherein $$\omega_0 = \frac{2\pi}{P},$$

P is a said further candidate pitch value and k is an integer, and selects as the value of pitch for the frame the further candidate pitch value giving the maximum correlation.

13. A speech coder as claimed in claim 1 wherein said pitch determination means determines a first value of pitch for a leading part of each frame and a second value of pitch for a trailing part of each frame, and said quantisation means quantises both said values of pitch.

14. A speech coder as claimed in any one of claims 1 to 13 wherein said voicing means determines for each frame at least one voicing cut-off frequency for separating a frequency spectrum from the frame into a voiced part and an unvoiced part, and wherein said amplitude determination means generates spectral amplitudes for each frame in response to a said voicing cut-off frequency and a said value of pitch determined by the voicing means and the pitch determination means respectively.

15. A speech coder as claimed in claim 14, wherein for each frame said voicing means performs the following steps:

(i) derives a voicing measure for each frequency band harmnonically related to a said pitch value determined by the determination means, (ii) compares the voicing measure for each harmonic frequency band with a threshold value to generate a comparison value which may be a positive value or a negative value, (iii) biasses each comparison value by an amount which reverses the sign of the comparison value if the corresponding harmonic frequency band lies above a trial cut-off frequency, (iv) sums the biassed comparison values over several harmonic frequency bands in the frame, (v) repeats steps (i) to (iv) above for a plurality of different trial cut-off frequencies, and (vi) selects as a voicing cut-off frequency for the frame the trial cut-off frequency giving the maximum summation.

16. A speech coder as claimed in claim 15, wherein said voicing measure is formed by correlating the shape of said harmonic frequency band with a reference shape for the band.

17. A speech coder as claimed in claim 16 including means for applying a window function to the input speech signal and deriving from the windowed input speech signal said frequency spectrum containing said harmonic frequency bands, and wherein said reference shape is derived from said window function.

18. A speech coder as claimed in claim 14 wherein said voicing means determines a first said voicing cut-off frequency for a leading part of each frame and a second said voice cut-off frequency for a trailing part of each frame.

19. A speech coder as claimed in claim 15 wherein said threshold value is dependent on the level of a background component in the input speech signal.

20. A speech coder as claimed in claim 19 wherein said voicing means evaluates an estimate of said threshold value in dependence on said level of a background component, modifies the estimate according to the value of one or more of E−lf/E−hf, $T_2/T_1$, ZC or ER as hereinbefore defined and further modifies the estimate according to the value of one or more of PKY1,PKY2, CM and E- OR as hereinbefore defined.

21. A speech coder as claimed in claim 1 wherein said amplitude determination means generates, for each frame, a set of spectral amplitudes for different frequency bands centred on frequencies harmonically related to a said value of pitch determined by the pitch determination means, and said quantisation means quantises the spectral amplitudes to generate a first part of an amplitude quantisation index.

22. A speech coder as claimed in claim 1 further including a decoder, comprising means for decoding the quantisation indices generated by a said encoder and means for processing the decoded quantisation indices to generate a sequence of digital signals representing the input speech signal.

23. A speech coder including an encoder for encoding an input speech signal, the encoder comprising means for sampling the input speech signal to produce digital samples and for dividing the samples into frames each consisting of a predetermined number of samples, linear predictive coding (LPC) means for analysing samples and generating at least one set of linear prediction coefficients for each frame, pitch determination means for determining at least one value of pitch for each frame, voicing means for defining a measure of voiced and unvoiced signals in each frame, amplitude determination means for generating amplitude information for each frame, and quantisation means for quantising said set of linear prediction coefficients, said value of pitch, said measure of voiced and unvoiced signals and said amplitude information to generate a set of quantisation indices for each frame, wherein said pitch determination means includes pitch estimation means for determining an estimate of the value of pitch and pitch refinement means for deriving the value of pitch from the estimate, the pitch refinement means defining a set of candidate pitch values including fractional values distributed about said estimate of the value of pitch determined by the pitch estimation means, identifying peaks in a frequency spectrum of the frame, for each said candidate pitch value correlating said peaks with amplitudes at different harmonic frequencies ($k\omega_o$) of a frequency spectrum of the frame, where $$\omega_0 = \frac{2\pi}{P},$$

P is a said candidate pitch value and k is an integer, and selecting as a said value of pitch for the frame the candidate pitch value giving the maximum correlation.

24. A speech coder as claimed in claim 23 wherein said pitch estimation means includes first estimation means for analysing samples using a frequency domain technique (frequency domain analysis), second estimation means for analysing samples using a time domain technique (time domain analysis) and means for deriving sad estimate of the value of pitch from the results of said time and frequency domain analyses.

25. A speech coder as claimed in claim 23 wherein the pitch refinement means correlates the amplitudes of said peaks with amplitudes at harmonic frequencies ($k\omega_o$) of an exponentially decaying envelope of the frequency spectrum in which the peaks were identified.

26. A speech coder as claimed in claim 23 wherein said voicing means determines for each frame at least one voicing cut-off frequency for separating a frequency spectrum from the frame into a voiced part and an unvoiced part, and wherein said amplitude determination means generates spectral amplitudes in response to said voicing cut-off frequency and said value of pitch determined by the voicing means and the pitch determination means respectively.

27. A speech coder as claimed in claim 26, wherein for each frame said voicing means performs the following steps:

(i) derives a voicing measure for each frequency band harmonically related to said pitch value determined by the pitch determination means, (ii) compares the voicing measure for each harmonic frequency band with a threshold value to generate a comparison value which may be a positive value or a negative value, (iii) biasses each comparison value by an amount which reverses the sign of the comparison value if the corresponding harmonic frequency band lies above a trial cut-off frequency, (iv) sums the biassed comparison values over several harmonic frequency bands in the frame, (v) repeats steps (i) to (iv) above for a plurality of different trial cut-off frequencies, and (vi) selects as a voicing cut-off frequency for the frame the trial cut-off frequency giving the maximum summation.

28. A speech coder as claimed in claim 27 wherein said voicing measure is formed by correlating the shape of said harmonic frequency band with a reference shape for the band.

29. A speech coder as claimed in claim 28 including means for applying a window function to the input speech signal and deriving from the windowed input speech signal a frequency spectrum containing said harmonic frequency bands, and wherein said reference shape is derived from said window function.

30. A speech coder as claimed in claim 26 wherein said voicing means generates a first said voicing cut-off frequency for a leading part of each frame and a second said voicing cut-off frequency for a trailing part of each frame.

31. A speech coder as claimed in claim 27 wherein said threshold value is dependent on the level of a background component in the input speech signal.

32. A speech coder as claimed in claim 23 wherein said amplitude determination means generates, for each frame, a set of spectral amplitudes for different frequency bands centred on frequencies harmonically related to a value of pitch determined by the pitch determination means and said quantisation means quantises the spectral amplitudes to generate a first part of an amplitude quantisation index.

33. A speech coder as claimed in claim 23 wherein said pitch determination means determines a first value of pitch for a leading part of each frame and a second value of pitch for a trailing part of each frame, and said quantisation means quantises both said values of pitch.

34. A speech coder as claimed in claim 23 further including a decoder, comprising means for decoding the quantisation indices generated by a said encoder and means for processing the decoded quantisation indices to generate a sequence of digital signals representing the input speech signal.

35. A speech coder including an encoder for encoding an input speech signal, the encoder comprising means for sampling the input speech signal to produce digital samples and for dividing the samples into frames, each consisting of a predetermined number of samples, linear predictive coding (LPC) means for analysing samples and generating at least one set of linear prediction coefficients for each frame, pitch determination means for determining at least one value of pitch for each frame, voicing means for determining for each frame a voicing cut-off frequency for separating a frequency spectrum from the frame into a voiced part and an unvoiced part without evaluating the voiced/unvoiced status of individual harmonic frequency bands, amplitude determination means for generating amplitude information for each frame, and quantisation means for quantising said set of coefficients, said value of pitch, said voicing cut-off frequency and said amplitude information to generate a set of quantisation indices for each frame.

36. A speech coder as claimed in claim 35, wherein for each frame said voicing means performs the following steps:

(i) derives a voicing measure for each frequency band harmonically related to said pitch value determined by the pitch determination means, (ii) compares the voicing measure for each harmonic frequency band with a threshold value to generate a comparison value which may be a positive value or a negative value, (iii) biasses each comparison value by an amount which reverses the sign of the comparison value if the corresponding harmonic frequency band lies above a trial cut-off frequency, (iv) sums the biassed comparison values over several harmonic frequency bands in the frame, (v) repeats steps (i) to (iv) above for a plurality of different trial cut-off frequencies, and (vi) selects as a voicing cut-off frequency for the frame the trial cut-off frequency giving the maximum summation.

37. A speech coder as claimed in claim 36 wherein said voicing measure is formed by correlating the shape of each harmonic frequency band with a reference shape for the band.

38. A speech coder as claimed in claim 27 including means for applying a window function to the input speech signal and deriving from the windowed input speech signal a frequency spectrum containing said harmonic frequency bands, and wherein said reference shape is derived from said window finction.

39. A speech coder as claimed in claim 36 wherein said threshold value is dependent on the level of a background component in the input speech signal.

40. A speech coder as claimed in claim 35 wherein said voicing means determines a first voicing cut-off frequency for a leading part of each frame and a second voicing cut-off frequency for a trailing part of each frame, and said quantisation means quantises both said values of voicing cut-off frequency.

41. A speech coder as claimed in claim 35 further including a decoder, comprising means for decoding the quantisation indices generated by a said encoder and means for processing the decoded quantisation indices to generate a sequence of digital signals representing the input speech signal.

42. A speech coder including an encoder for encoding an input speech signal, the encoder comprising, means for sampling the input speech signal to produce digital samples and for dividing the samples into frames each consisting of a predetermined number of samples, linear predictive coding (LPC) means for analysing samples and generating at least one set of linear prediction coefficients for each frame, pitch determination means for determining at least one value of pitch for each frame, voicing means for defining a measure of voiced and unvoiced signals in each frame, amplitude determination means for generating amplitude information for each frame, and quantisation means for quantising said set of prediction coefficients, said value of pitch, said measure of voiced and unvoiced signals and said amplitude information to generate a set of quantisation indices for each frame, wherein the amplitude determination means generates, for each frame, a set of spectral amplitudes for frequency bands centred on frequencies harmonically related to the value of pitch determined by the pitch determination means, and the quantisation means quantises the normalised spectral amplitudes to generate a first part of an amplitude quantisation index.

43. A speech coder as claimed in claim 42, wherein the spectral amplitudes for each frame are derived from an LPC residual signal for the frame.

44. A speech coder as claimed in claim 42, wherein the spectral amplitudes for each frame are quantised by reference to an LPC frequency spectrum derived from prediction coefficients for the frame.

45. A speech coder as claimed in claim 42 further including a decoder, comprising means for decoding the quantisation indices generated by a said encoder and means for processing the decoded quantisation indices to generate a sequence of digital signals representing the input speech signal.

46. A speech coder as claimed in claim 42 including a decoder comprising means for decoding the quantisation indices generated by a said encoder and processing means for processing the decoded quantisation indices to generate a sequence of digital samples representing the input speech signal, wherein the processing means includes means for weighting the decoded spectral amplitudes derived from said first part of the amplitude quantisation index by weighting factors derived from the ration of an LPC frequency spectrum derived from the decoded prediction coefficients and a corresponding peak-interpolated LPC frequency spectrum.

47. A speech coder including an encoder for encoding an input speech signal, the encoder comprising means for sampling the input speech signal to produce digital samples and for dividing the samples into frames each consisting of a predetermined number of samples, linear predictive coding means for analysing samples to generate a respective set of Line Spectral Frequency (LSF) coefficients for a leading part and for a trailing part of each frame, pitch determination means for determining at least one value of pitch for each frame, voicing means for defining a measure of voiced and unvoiced signals in each frame, amplitude determination means for generating amplitude information for each frame, and quantisation means for quantising said sets of LSF coefficients, said value of pitch, said measure of voiced and unvoiced signals and said amplitude information to generate a set of quantisation indices, wherein said quantisation means defines a set of quantised LSF coefficients (LSF'2) for the leading part of the current frame by the expression $$LSF'2=\alpha LSF'1+(1-\alpha)LSF'3,$$

where LSF'3 and LSF'1 are respectively sets of quantised LSF coefficients for the trailing parts of the current frame and the frame immediately preceding the current frame, and a is a vector in a first vector quantisation codebook, defines each said set of quantised LSF coefficients LSF'2, LSF'3 for the leading and trailing parts respectively of the current frame as a combination of respective LSF quantisation vectors Q2,Q3 of a second vector quantisation codebook and respective prediction values P2,P3, where P2=λQ1 and P3=λQ2, λ is a constant and Q1 is a said LSF quantisation vector for the trailing part of said immediately preceding frame, and selects said vector Q3 and said vector a from the first and second vector quantisation codebooks respectively to minimise a measure of distortion between the LSF coefficients generated by the linear predictive coding means (LSF2, LSF3) for the current frame and the corresponding quantised LSF coefficients (LSF'2, LSF'3).

48. A speech coder as claimed in claim 47 wherein said second vector quantisation codebook contains at least two groups of said vectors with reference to which respective groups of LSF coefficients in a set are quantised.

49. A speech coder as claimed in claim 47 wherein said measure of distortion is an error function $$\epsilon = W_1(LS'3 - LSF3)^2 + W_2(LSF'2 - LSF2)^2,$$

where $W_1$ and $W_2$ are perceptual weights.

50. A speech coder as claimed in claim 47 further including a decoder, comprising means for decoding the quantisation indices generated by a said encoder and means for processing the decoded quantisation indices to generate a sequence of digital signals representing the input speech signal.

51. A speech coder for decoding a set of quantisation indices representing LSF coefficients, pitch value, a measure of voiced and unvoiced signals and amplitude information, including processor means for deriving an excitation signal from said indices representing pitch value, measure of voiced and unvoiced signals and amplitude information, a LPC synthesis filter for filtering the excitation signal in response to said LSF coefficients, means for comparing pitch cycle energy at the LPC synthesis filter output with corresponding pitch cycle energy in the excitation signal, means for modifying the excitation signal to reduce a difference between the compared pitch cycle energies and a further LPC synthesis filter for filtering the modified excitation signal.

* * * * *